US012774069B2

(12) United States Patent
Bragg et al.

(10) Patent No.: US 12,774,069 B2
(45) Date of Patent: Oct. 27, 2026

(54) BRAKING SYSTEM FOR A PEDAL DRIVE SYSTEM FOR WATERCRAFT

(71) Applicants: Timothy A. Bragg, Winterport, ME (US); Geoffrey Michael Bergmark, Bangor, ME (US); Sean Rusch, Cedarburg, WI (US); Sheng-Yiung Lin, Pingtung County (TW); Mao-Hua Hung, Kaohsiung City (TW); Chen-Lun Hung, Pingtung County (TW); Chih Ching Chen, Pingtung County (TW); Chia-Yu Ke, Pingtung County (TW)

(72) Inventors: Timothy A. Bragg, Winterport, ME (US); Geoffrey Michael Bergmark, Bangor, ME (US); Sean Rusch, Cedarburg, WI (US); Sheng-Yiung Lin, Pingtung County (TW); Mao-Hua Hung, Kaohsiung City (TW); Chen-Lun Hung, Pingtung County (TW); Chih Ching Chen, Pingtung County (TW); Chia-Yu Ke, Pingtung County (TW)

(73) Assignee: Johnson Outdoors Inc., Racine, WI (US)

( * ) Notice: Subject to any disclaimer, the term of this patent is extended or adjusted under 35 U.S.C. 154(b) by 380 days.

(21) Appl. No.: 18/529,847

(22) Filed: Dec. 5, 2023

(65) Prior Publication Data

US 2024/0190548 A1 Jun. 13, 2024

Related U.S. Application Data

(60) Provisional application No. 63/431,963, filed on Dec. 12, 2022.

(51) Int. Cl.
*B63H 16/20* (2006.01)
*B63H 23/32* (2006.01)

(52) U.S. Cl.
CPC ..... *B63H 16/20* (2013.01); *B63H 2016/202* (2013.01); *B63H 2023/328* (2013.01)

(58) Field of Classification Search
CPC ..... B63H 16/20; B63H 2016/202; B63H 2023/328
See application file for complete search history.

(56) References Cited

U.S. PATENT DOCUMENTS 1,121,955 A 12/1914 Tracy
2,091,269 A 8/1937 Colman
(Continued)

FOREIGN PATENT DOCUMENTS

CA 2087736 A1 4/1994
CA 2192860 A1 6/1998
(Continued)

OTHER PUBLICATIONS

Lake George Kayak Co; Ultimate 14.5 Volt; internet printout accessed on Oct. 2, 2015; 2 pages; http://www.lakegeorgekayak.com/Native_kayaks_Ultimate_14.5_Volt_specs.htm.
(Continued)

*Primary Examiner* — Stephen P Avila
(74) *Attorney, Agent, or Firm* — Reinhart Boerner Van Deuren P.C.

(57) ABSTRACT

Braking arrangements for inhibiting pedals of a pedal drive system for a watercraft from rotating when an assist drive train of the pedal drive system is activated are provided. Method of preventing pedals of a pedal drive system for a watercraft from rotating when using an assist mode are provided.

20 Claims, 17 Drawing Sheets

(56) References Cited

U.S. PATENT DOCUMENTS

| | | | | |
|---|---|---|---|---|
| 4,676,755 | A | 6/1987 | Yagan | |
| 4,872,859 | A | 10/1989 | Griffiths et al. | |
| 5,129,845 | A | 7/1992 | Henderson | |
| 5,362,264 | A | 11/1994 | Parant | |
| 5,758,736 | A | 6/1998 | Yamauchi | |
| 5,938,489 | A | 8/1999 | McNeil | |
| 6,022,249 | A | 2/2000 | Ketterman | |
| 6,171,157 | B1 | 1/2001 | Knapp | |
| 6,210,242 | B1 | 4/2001 | Howard et al. | |
| 6,458,004 | B2 | 10/2002 | Van Breems | |
| 6,855,016 | B1 | 2/2005 | Jansen | |
| 7,021,978 | B2 | 4/2006 | Jansen | |
| 7,530,867 | B2 | 5/2009 | Jackson | |
| 7,549,902 | B2 | 6/2009 | Jansen | |
| 7,637,791 | B2 | 12/2009 | Ketterman et al. | |
| 7,887,381 | B2 | 2/2011 | Brass et al. | |
| 8,337,266 | B2 | 12/2012 | Ellis et al. | |
| 8,342,897 | B2 | 1/2013 | Gater et al. | |
| 8,398,446 | B2 | 3/2013 | Railey et al. | |
| 8,529,306 | B2 | 9/2013 | Baldwin | |
| 8,753,156 | B2 | 6/2014 | Ketterman et al. | |
| 9,150,295 | B2 | 10/2015 | West et al. | |
| 9,248,897 | B2 | 2/2016 | Shields | |
| 9,290,233 | B2 | 3/2016 | Goin | |
| 9,302,755 | B2 | 4/2016 | Wolfe | |
| 9,359,056 | B2 | 6/2016 | Lyons et al. | |
| 9,428,255 | B2 | 8/2016 | Santa Catarina | |
| 9,463,857 | B1 | 10/2016 | Schiller et al. | |
| 9,475,559 | B2 | 10/2016 | Czarnowski et al. | |
| 9,623,944 | B2 | 4/2017 | Kuehmichel et al. | |
| 9,701,367 | B2 | 7/2017 | McDonough et al. | |
| 9,725,149 | B2 | 8/2017 | Kiffmeyer et al. | |
| 9,731,802 | B2 | 8/2017 | Ketterman et al. | |
| 9,738,362 | B2 | 8/2017 | Ketterman et al. | |
| 9,758,220 | B1 | 9/2017 | Zimmerman et al. | |
| 9,834,285 | B2 | 12/2017 | Orenes Lopez | |
| 9,914,519 | B2 | 3/2018 | Nutz et al. | |
| 9,981,726 | B2 | 5/2018 | Ketterman et al. | |
| 9,981,727 | B2 | 5/2018 | Shields | |
| 9,988,133 | B2 | 6/2018 | Murphy | |
| 10,005,531 | B1 | 6/2018 | Broadway et al. | |
| 10,124,873 | B2 | 11/2018 | Aguirre | |
| 10,150,544 | B2 | 12/2018 | Schibli | |
| 10,458,788 | B2 | 10/2019 | Fyfe et al. | |
| 10,538,301 | B2 | 1/2020 | Murphy | |
| 10,946,238 | B1 * | 3/2021 | Rogus | A63B 22/001 |
| 11,148,775 | B2 | 10/2021 | Kuehmichel | |
| 2002/0142679 | A1 | 10/2002 | Ibata et al. | |
| 2002/0195039 | A1 | 12/2002 | Anderson | |
| 2005/0255761 | A1 | 11/2005 | Bernloehr et al. | |
| 2005/0268833 | A1 | 12/2005 | Conrad | |
| 2007/0012236 | A1 | 1/2007 | Caples | |
| 2008/0200079 | A1 | 8/2008 | Jansen | |
| 2008/0299842 | A1 | 12/2008 | Ellis et al. | |
| 2009/0031941 | A1 | 2/2009 | Czarnowski et al. | |
| 2009/0042461 | A1 | 2/2009 | Walton | |
| 2009/0311926 | A1 | 12/2009 | Ketterman et al. | |
| 2010/0075550 | A1 | 3/2010 | Bortsov et al. | |
| 2010/0162938 | A1 | 7/2010 | Halfon | |
| 2012/0238159 | A1 | 9/2012 | Palvoelgyi et al. | |
| 2013/0059489 | A1 | 3/2013 | Vlock et al. | |
| 2013/0206540 | A1 | 8/2013 | Wang | |
| 2014/0134901 | A1 | 5/2014 | Ketterman et al. | |
| 2014/0138174 | A1 * | 5/2014 | Getta | F16D 67/02 180/220 |
| 2015/0210364 | A1 | 7/2015 | Choi | |
| 2018/0009515 | A1 | 1/2018 | Murphy | |
| 2018/0265179 | A1 | 9/2018 | Shields | |
| 2021/0061429 | A1 | 3/2021 | Kuehmichel | |
| 2021/0107603 | A1 * | 4/2021 | Howard-Willis | B63B 1/26 |
| 2021/0229790 | A1 | 7/2021 | Cloutier et al. | |
| 2021/0284309 | A1 | 9/2021 | Kuehmichel et al. | |
| 2022/0033045 | A1 | 2/2022 | Kuehmichel | |
| 2023/0174210 | A1 | 6/2023 | Kuehmichel et al. | |

FOREIGN PATENT DOCUMENTS

| | | | |
|---|---|---|---|
| CA | 2209047 | A1 | 1/1999 |
| CN | 1646361 | A | 7/2005 |
| CN | 102120487 | A | 7/2011 |
| CN | 102264598 | A | 11/2011 |
| CN | 102753429 | A | 10/2012 |
| CN | 209700906 | U | 11/2019 |
| EP | 2666708 | A2 | 11/2013 |
| GB | 2403461 | A | 1/2005 |
| KR | 101801636 | B1 | 11/2017 |
| TW | 329219 | U | 4/1998 |
| WO | WO 2012/094686 | A2 | 7/2012 |
| WO | WO 2019/016419 | A1 | 1/2019 |

OTHER PUBLICATIONS ack.com; Ocean Kayak Torque Motorized Fishing Kayak; internet printout accessed on Oct. 2, 2015; 2 pages; http://www.austinkayak.com/products/14575/Ocean-Kayak-Torque-Motorized-Fishing-Kayak.html.

Hobie Evolve; Hobie evolve Control Unit; internet printout accessed on Oct. 2, 2015; 2 pages; http://www.hobiecat.com/accessories/evolve.

kayakfishingstuff.com; Ocean Kayak Torque; internet printout accessed on Oct. 2, 2015; 3 pages; http://www.kayakfishingstuff.com/drupal/content/ocean-kayak-torque.

Propel Drive, Native Watercraft; "Forward + Reverse = Fishing Success"; pages printed from the in internet; date last visited Oct. 2, 2015; 5 pages; http://www.firstwithreverse.com/propel-drive/.

Miragedrive: Hobie Cat; Mirage Drive with Glide Technology; pages printed from the internet; date last visited Oct. 2, 2015; 2 pages; http://www.hobiecat.com/mirage/miragedrive.

* cited by examiner

BRAKING SYSTEM FOR A PEDAL DRIVE SYSTEM FOR WATERCRAFT

CROSS-REFERENCE TO RELATED PATENT APPLICATION

This patent application claims the benefit of U.S. Provisional Patent Application No. 63/431,963, filed Dec. 12, 2022, the entire teachings and disclosure of which are incorporated herein by reference thereto.

FIELD OF THE INVENTION

This invention generally relates to pedal drive systems for watercraft and particularly pedal drive systems for watercraft that include an assist drive train and a manual drive train.

BACKGROUND OF THE INVENTION

Watercraft such as kayaks have been incorporated with pedal drives and more recently pedal drives that incorporate an assist system that incorporates a motor that can be selectively activated to power the thrust unit when the operator no longer wants to provide manual power or wants to provide all of the manual power. Such systems are illustrated in U.S. Patent Publ. 2021/0284309 and U.S. Pat. No. 11,148,775.

It has been determined that in some implementations that when the user transitions to assist power, the assist drive train can often cause the crankshaft to rotate even when the user desires to rely solely on assist power, e.g. from power provided by the motor. For example, in some implementations, a one-way clutch is provided to decouple the crankshaft that is driven manually by pedaling from gearing within the system that is driven by the motor of the assist drive train in the assist mode(s). However, the one-way clutch may provide sufficient friction that without out the resistance provided by the users feet on the pedals, the crankshaft will be driven by the motor through the one-way clutch and the crankshaft will not be overrun by the corresponding gearing.

This can cause, undesirably, the crankshaft to rotate thereby rotating the pedals with the crankshaft. This can result in the pedals hitting the user when the user has removed his or her feet from the pedals.

SUMMARY OF THE INVENTION

Examples of the application provide new and improved pedal drive systems for a watercraft and particularly pedal drive systems that include both a manual drive train and assist drive train.

In an example, a pedal drive system for a watercraft having a thrust unit, a manual drive train, and an assist drive train, and a manual drive train brake is provided. The thrust unit may have a propeller or other thrust device. The manual drive train includes a pair of pedals mechanically attached to a crankshaft for rotation of the crankshaft about a crankshaft axis. In at least a manual pedal mode, the manual drive train is connected to the thrust unit to input power to the thrust unit by pedaling of the pair of pedals. The assist drive train has a motor. In at least an assist mode, the assist drive train is connected to the thrust unit to input power to the thrust unit. The manual drive train brake acts on the manual drive train such that when the assist drive train is powering the thrust unit in the assist mode, motion of the crankshaft about the crankshaft axis is inhibited.

In one example, the crankshaft is rotatably mounted to a drive system housing. The manual drive train brake includes a first friction pad fixed relative to the drive system housing such that rotation of the crankshaft does not rotate the first friction pad. The manual drive train brake includes a second friction pad attached to the crankshaft for rotation with the crankshaft about the crankshaft axis. The second friction pad engaging the first friction pad at least when in the assist mode to inhibit rotation of the crankshaft when the motor powers the thrust unit.

In one example, the first friction pad is biased against the second friction pad by a biasing member.

In one example, the biasing member is at least one of a wave spring, a conical spring, an o-ring, or a threaded ring that is threaded into the drive system housing.

In one example, the biasing member provides a biasing force parallel to the crankshaft axis.

In one example, the manual drive train brake includes a third friction pad fixed relative to the drive system housing such that rotation of the crankshaft does not rotate the third friction pad. The second friction pad is sandwiched axially between the first and third friction pads.

In one example, at least one of the first and second friction pads are axially slidable along the crankshaft axis.

In one example, the manual drive train brake includes an anti-squeak shim interposed between the biasing member and the third friction pad. The third friction pad directly engages the second friction pad and the anti-squeak shim. The biasing member directly engages the anti-squeak shim.

In one example, a manual drive train brake cover portion is fixed relative to the drive system housing. The first and second friction pads are located within the manual drive train brake cover portion, the manual drive train brake cover portion providing a dust vent.

In one example, the dust vent is located vertically lower than the crankshaft axis.

In one example, the manual drive train brake includes a third friction pad fixed relative to the drive system housing such that rotation of the crankshaft does not rotate the third friction pad. The second friction pad is sandwiched axially between the first and third friction pads. The biasing member biases the third friction pad and the second friction pad towards the first friction pad. The second friction pad is axially slidable along the crankshaft axis towards the first friction pad upon wear of second, first or second and first friction pads.

In one example, the manual drive train brake includes a third friction pad fixed relative to the drive system housing such that rotation of the crankshaft does not rotate the third friction pad. The second friction pad is sandwiched axially between the first and third friction pads. The biasing member biases the third friction pad and the second friction pad towards the first friction pad. The third friction pad is axially slidable along the crankshaft axis towards the first friction pad upon wear of the first, second, or third friction pads or any combination thereof.

In one example, the crankshaft is rotatably mounted to a drive system housing. The manual drive train brake includes a first magnet member fixed relative to the drive system housing such that rotation of the crankshaft does not rotate the first magnet member. The manual drive train brake includes a second magnet member operably attached to the crankshaft for rotation with the crankshaft about the crankshaft axis. The second magnet member interacts with the first magnet member at least when in the assist mode to inhibit rotation of the crankshaft when the motor powers the thrust unit.

In one example, the first and second magnet members attract one another.

In one example, a third magnet member is provided. The third magnet member is either:

A) fixed relative to the drive system housing and having the same magnetic characteristic as the first magnet member or B) operably attached to the crankshaft for rotation with the crankshaft about the crankshaft axis and having the same magnetic characteristic as the second magnet member.

In one example, at least one of the first and second magnet members is an electromagnet that can be activated and deactivated.

In one example, the electromagnet is activated when in the assist mode and is deactivated when in the manual mode.

In one example, the electromagnet is automatically activated when assist mode is activated.

In one example, the second magnet is attached to a crank arm of the manual drive train. The crank arm is attached to the crankshaft and extends radially relative to the crankshaft axis.

In one example, the crankshaft is rotatably mounted to a drive system housing. The manual drive train brake includes a fluid housing fixed relative to the drive system housing such that rotation of the crankshaft relative to the drive system housing does not rotate the fluid housing. The manual drive train brake includes a fluid located within the fluid housing. The manual drive train brake includes a rotor element engaging the fluid within the fluid housing. The rotor element is operably attached to the crankshaft to rotate with the crankshaft when in the assist mode to inhibit rotation of the crankshaft when the motor powers the thrust unit.

In one example, the crankshaft is rotatably mounted to a drive system housing. The manual drive train brake includes a manual lever mounted to drive system housing. The manual lever is movable between a blocking position and a retracted position. In the blocking position, the manual lever is configured to engage a crank arm radially extending from the crankshaft and prevent rotation of the crankshaft in a first direction about the crankshaft axis when in the assist mode due to the motor powering the thrust unit. In the retracted position, the manual lever does not engage the crank arm when the crankshaft is rotated about the crankshaft axis.

In one example, when in the blocking position, the manual lever is configured to transition towards the retracted position when engaged by the crank arm when the crankshaft is rotated in a second direction, opposite the first direction.

In one example, when the crank arm rotates past the manual lever when the crankshaft is rotating in the second direction, the manual lever returns to the blocking position.

In one example, the manual lever has an over-center arrangement that opposes transitioning the manual lever into the retracted position from the blocking position when the manual lever has been transitioned into the blocking position and opposes transitioning the manual lever into the blocking position from the retracted position when the manual lever has been transitioned into the retracted position.

In one example, the manual lever is carried for rotation about an over-center axis relative to the drive system housing.

In one example, the manual drive train brake is active when in the manual mode.

In one example, the manual drive train brake is not active when in the manual mode.

In one example, the manual drive train brake is automatically deactivated when the assist mode is activated.

In one example, the manual drive train brake has an active configuration in which the first friction pad is biased against the second friction pad and a deactivated configuration in which the first friction pad is not biased against the second friction pad.

In one example, the manual drive train brake automatically transitions from the deactivated configuration to the active configuration when the assist mode is activated.

In one example, the manual drive train brake includes an actuator that transitions the manual drive train brake between the deactivated configuration and the active configuration.

In one example, a first gear is driven by the motor of the assist drive train for rotation about the crankshaft axis when in the assist mode to transfer power from the motor to the thrust unit. A one-way clutch is interposed between the first gear and the crankshaft that permits the first gear to overrun the crankshaft when the first gear is driven by the motor in the assist mode.

In one example, the crankshaft is operably connected to the first gear in the manual mode such that rotation of the crank drives the first gear when in the manual mode and transfers power from a pair of pedals operably connected to the crankshaft to the thrust unit via the first gear and the crankshaft.

In one example, a coupling arrangement having a manual mode and an assist mode is provided. The coupling arrangement includes a coupler that transitions the coupling arrangement between the manual mode and the assist mode. In the manual mode, the coupler mechanically couples the crankshaft to the thrust unit such that rotation of the crankshaft in a first angular direction about the crankshaft axis drives the thrust unit to output thrust in a first thrust direction and rotation of the crankshaft in a second angular direction, opposite the first angular direction, about the crankshaft axis drives the thrust unit to output thrust in a second thrust direction, opposite the first thrust direction. In the assist mode, the coupling arrangement couples the crankshaft to the thrust unit such that rotation of the crankshaft in the first angular direction about the crankshaft axis drives the thrust unit to output thrust in the first thrust direction and rotation of the crankshaft in the second angular direction about the crankshaft axis does not drive the thrust unit to output thrust in the second thrust direction. In the assist mode, the assist drive train is mechanically connected to the thrust unit such that when the motor is energized, the assist drive train drives the thrust unit to output thrust in the first thrust direction.

In an example, a watercraft includes a hull and a pedal drive system as outlined above mounted to the hull.

In an example, a method of operating a pedal drive system of a watercraft is provided. The pedal drive system is one as outlined above. The method includes inhibiting rotation of the crankshaft with the manual drive train brake when in the assist mode.

In an example, a method of operating a pedal drive system of a watercraft is provided. The pedal drive system is one as outlined above. The crankshaft is rotatably mounted to a drive system housing. The method includes providing an amount of resistance between the drive system housing and the crankshaft that is greater than an amount of torque provided between the one-way clutch and the crankshaft that drives the crankshaft through the one-way clutch.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, the same illustrate an exemplary embodiment of a watercraft 20 and an associated pedal drive system 22 constructed in accordance with the teachings herein. As will be explained in greater detail below, pedal drive system 22 can be operated in a manual mode or an assist mode. The manual mode allows for unassisted manual pedaling to provide thrust to watercraft 20.

In the assist mode, pedal drive system 22 also provides on pedal assistance of varying levels via an assist drive train having an electric motor to supplement the manual pedal force input provided by a user at the pedals of pedal drive system 22.

In an embodiment, in the manual mode, the assist drive train of the pedal drive system 22 is operably disconnected from the remainder of the system when not providing any pedal assist force to minimize the amount of additional manual pedal force beyond that required by traditional pedal drive systems that do not include any type of assist functionality.

Figure 1:
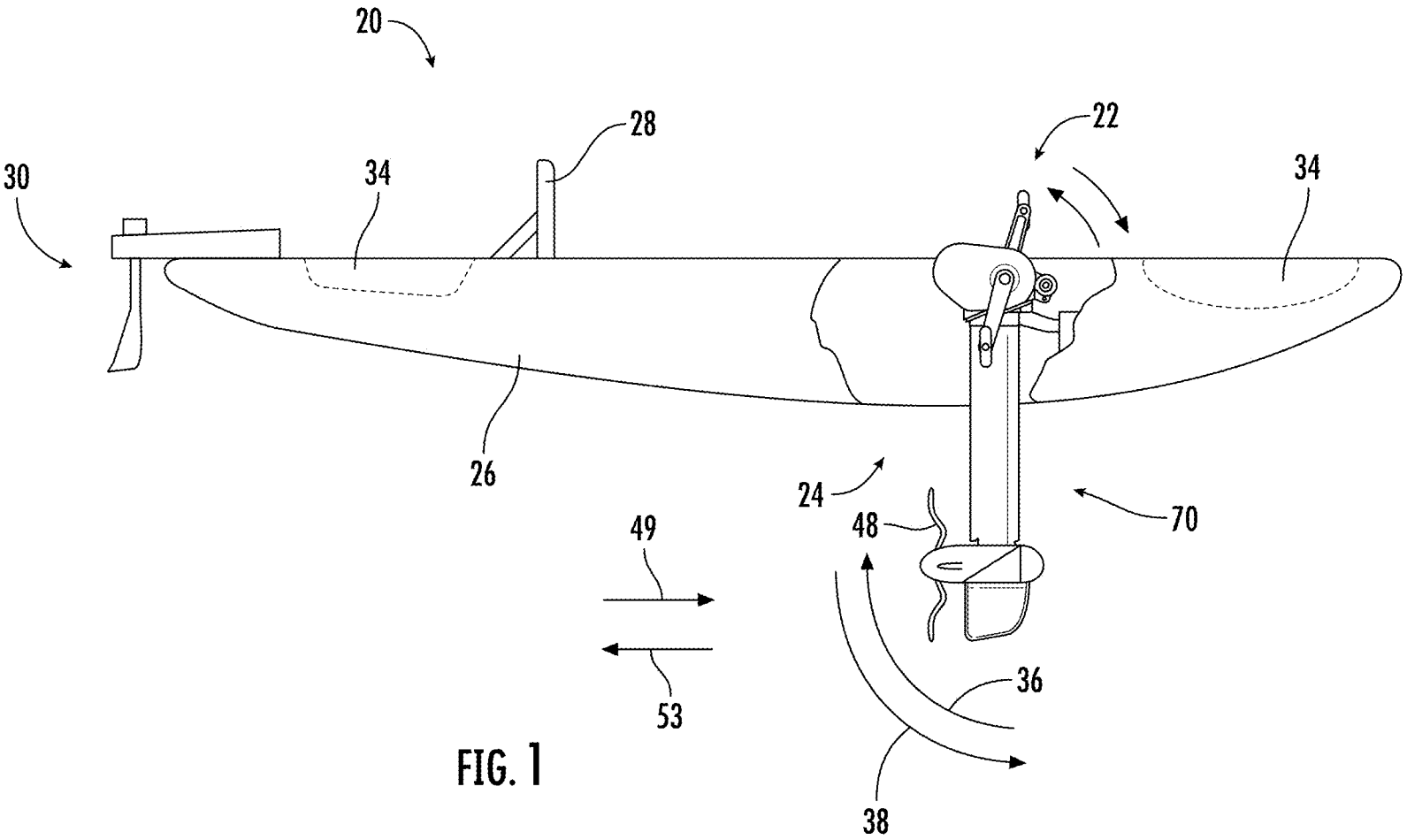
FIG. 1 is a simplified illustration of a watercraft including a pedal drive system.

With particular reference now to FIG. 1, watercraft 20 may take the form of any type of kayak or other similar watercraft (e.g. a canoe). In the exemplary embodiment, watercraft 20 can include an opening 24 in its hull 26 to allow a portion of pedal drive system 22 to extend below a bottom of hull 26 and provide thrust to watercraft that is converted from the manual pedal force and/or the pedal assist force provided by a user and/or pedal drive system 22.

Indeed, a user (not shown) may be seated in seat 28 and operate pedal drive system 22 as well as any steering controls as mentioned in the following.

Further, hull 26 may include one or more sealed or open top storage compartments 34.

Watercraft 20 can include a rudder system 30 and associated manual or automated controls to steer watercraft 20. The particular shape and size of watercraft 20 illustrated is purely exemplary and not limiting in any way on the invention herein. Further, the location, size, and shape of pedal drive system 22 relative to hull 26 is purely exemplary. For example, the portion of the pedal drive system 22 that extends into the water could be located where the rudder system 30 is located in some embodiments, replacing the need for rudder system 30.

It is envisioned that pedal drive system 22 may be incorporated into any watercraft where it may be desirable to include user pedal functionality.

Pedal drive system 22 may also be mounted to hull 26 such that it is movable generally in directions 36, 38 to selectively stow and deploy pedal drive system 22. To place pedal drive system 22 in a stowed position, pedal drive system 22 may be rotated in direction 36 such that it is generally stowed within opening 24 and does not extend downwardly through opening 24 as shown. To place pedal drive system 22 in a deployed position, the same may be rotated in direction 38 to place it generally in the illustrated configuration. Further, pedal drive system 22 may be rotated in direction 36 to completely remove it from hull 26. As such, appropriate seals and other structure may be employed so as to appropriately seal opening 24 when pedal drive system 22 is or is not present to reduce or eliminate the ingress of water into the interior of hull 26. However, such seals are not necessary for all watercraft.

Figure 2:
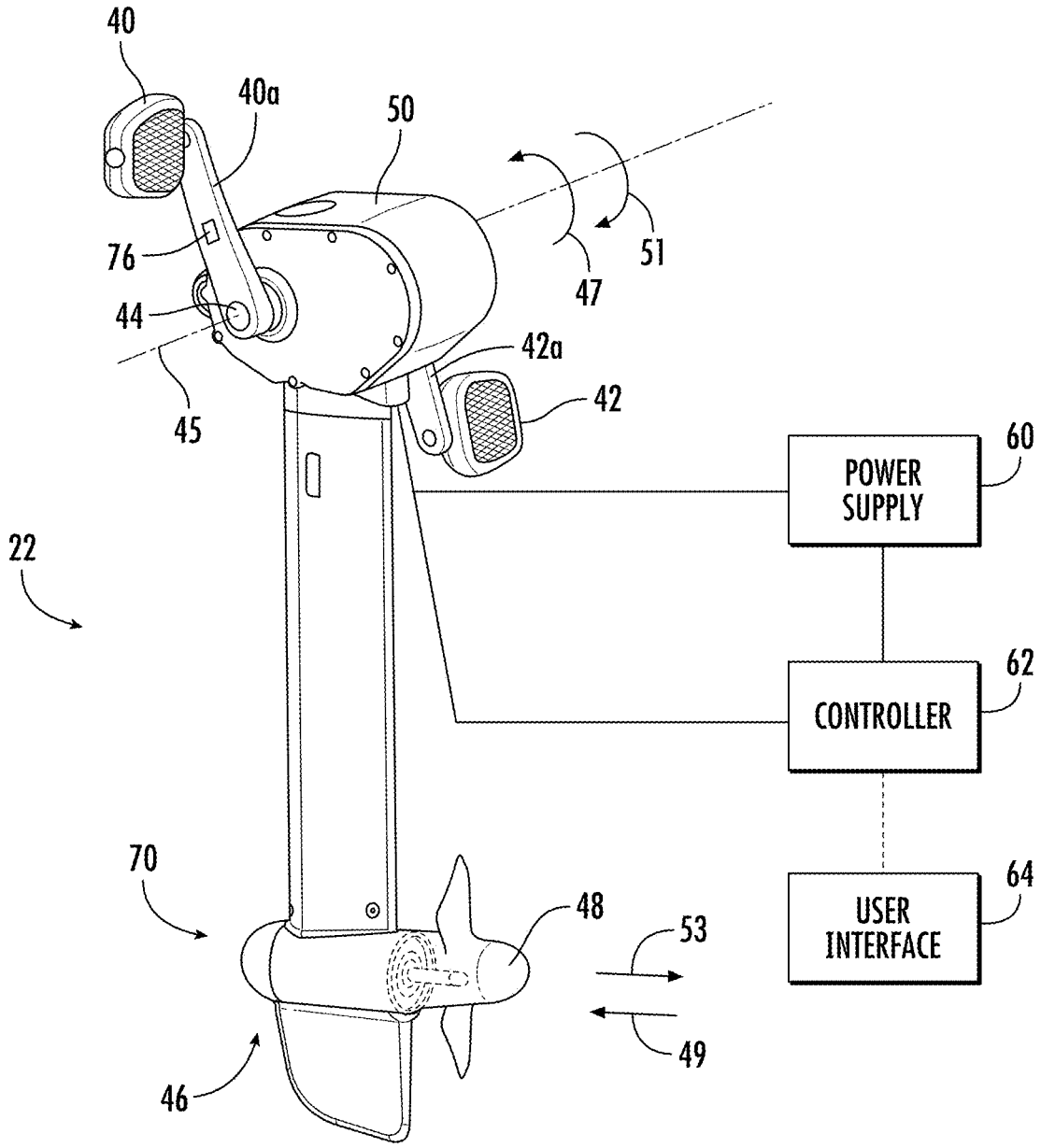
FIG. 2 is a simplified illustration of the pedal drive system of the watercraft of FIG. 1 having the pedal drive system removed from the watercraft.
Figure 3:
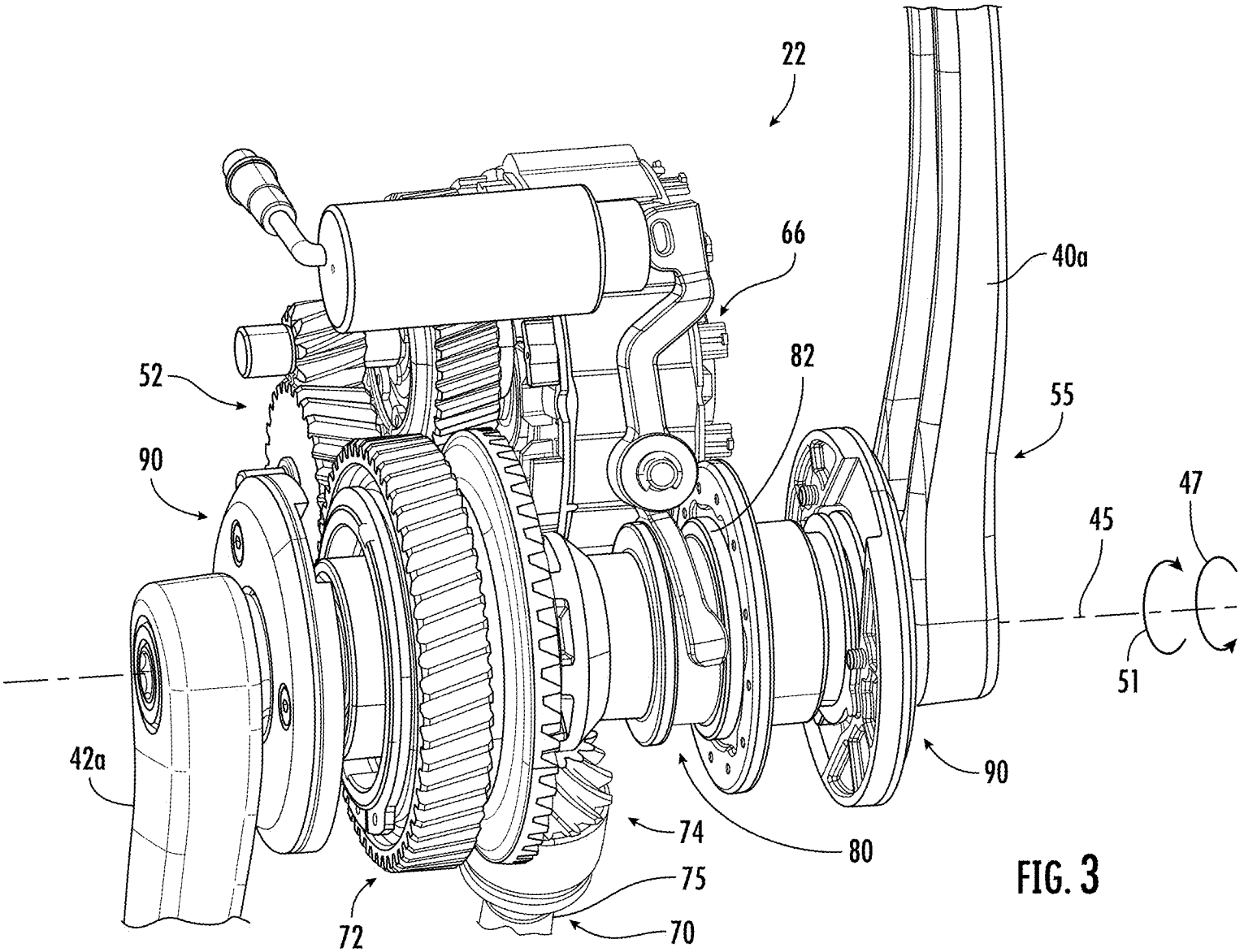
FIG. 3 is a simplified illustration of the manual and assist drive trains of the pedal drive system of FIG. 2.

Turning now to FIGS. 2 and 3, pedal drive system 22 is removed from watercraft 20. The pedal drive system 22 includes a thrust unit 70 that can provide thrust for moving the watercraft 20.

Pedal drive system 22 includes a pair of pedals 40, 42 where a user can provide manual pedal force input. Each pedal includes an associated crank 40*a*, 42*a*, respectively, which are mounted to a rotatable crankshaft 44 defining a crankshaft axis 45 extending longitudinally through shaft 44.

Rotation of the crankshaft 44 in a first angular direction 47 about crankshaft axis 45 creates a thrust force via propeller 48 in a first thrust direction 49 while rotation of the crankshaft 44 in a second angular direction 51, opposite the first angular direction 47, creates a thrust force via propeller 48 in a second thrust direction 53, opposite the first thrust direction 49. In this example, thrust force 49 will push the watercraft in a forward direction and thrust force 53 would push the watercraft in a reverse direction.

In this embodiment, the manual drive train 55 is provided primarily by crankshaft 44, cranks 40*a*, 42*a*, and pedals 40, 42.

Pedal drive system 22 also includes an assist drive train 52 for providing, via an electric motor 66, assist force, which may be very little or all of the force provided to drive thrust unit 70. A power supply 60 is associated with an electric motor 66 of assist drive train 52 and provides electrical power thereto. Power supply 60 may also provide power to a controller 62, the latter of which is utilized to monitor and control the operation of pedal drive system 22 based in part on inputs provided by a user interface 64. Power supply 60 may be any power source used in watercraft applications and, for non-limiting example, may be a marine battery.

Controller 62 may be a stand-alone controller housed within housing 50 or elsewhere on watercraft 20, and include all the necessary hardware, firmware, and software necessary for achieving the functionality described herein. Alternatively, controller 62 may be integrated into another device. For example, controller 62 may be integrated into a multi-function device e.g. a fish finder, a mobile device, or any other device readily available to the user which can receive inputs and send outputs. The term "integrated" in the foregoing includes not only combining the physical structure of controller 62 into such devices, but also includes embodying controller 62 entirely as a software program run on such devices. Indeed, many multi-function displays and mobile devices are fully capable of receiving inputs and sending outputs, and as such, it is entirely possible to utilize the existing hardware of such devices to operate as controller 62.

Controller 62 may communicate with pedal drive system 22 using a wired or wireless connection. In the case of a wireless connection, pedal drive system 22 can also include its own local hardware, software, and firmware necessary to communicate with such a remotely located controller 62 and respond to commands from controller 62. In addition to controlling the operation of the assist drive train 52, controller 62 may also control other aspects of the system such as battery life and power consumption.

Further, controller 62 can receive inputs relating to the operation of pedal drive system 22, so as to control the assist functionality provided thereby. For example, a torque sensor may be mounted to one or both of cranks 40*a*, 42*a*, and be in communication with controller 62. Alternatively, torque sensor may be mounted to any structure of pedal drive system 22 where it can sense a torque loading. Additionally or in the alternative to a torque sensor, a speed sensor may be used to, for example, monitor the revolutions per minute thereof. This speed sensor may also be in communication with controller 62. The torque and speed sensors may communicate via a wired or wireless connection with controller 62, and allow controller 62 to detect pedal 40, 42 speed and direction.

Figure 4:
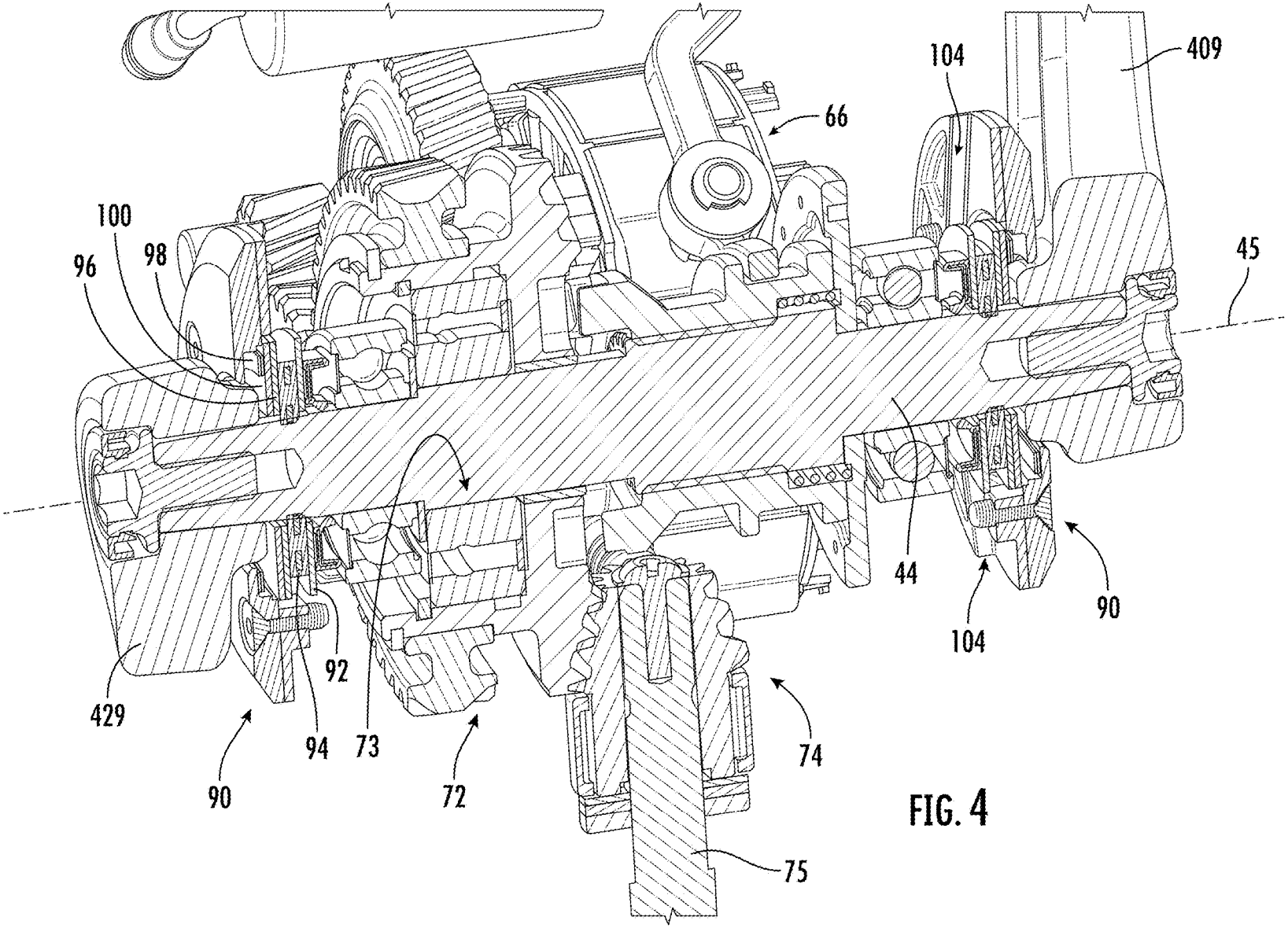
FIG. 4 is a cross-section of FIG. 3.
Figure 5:
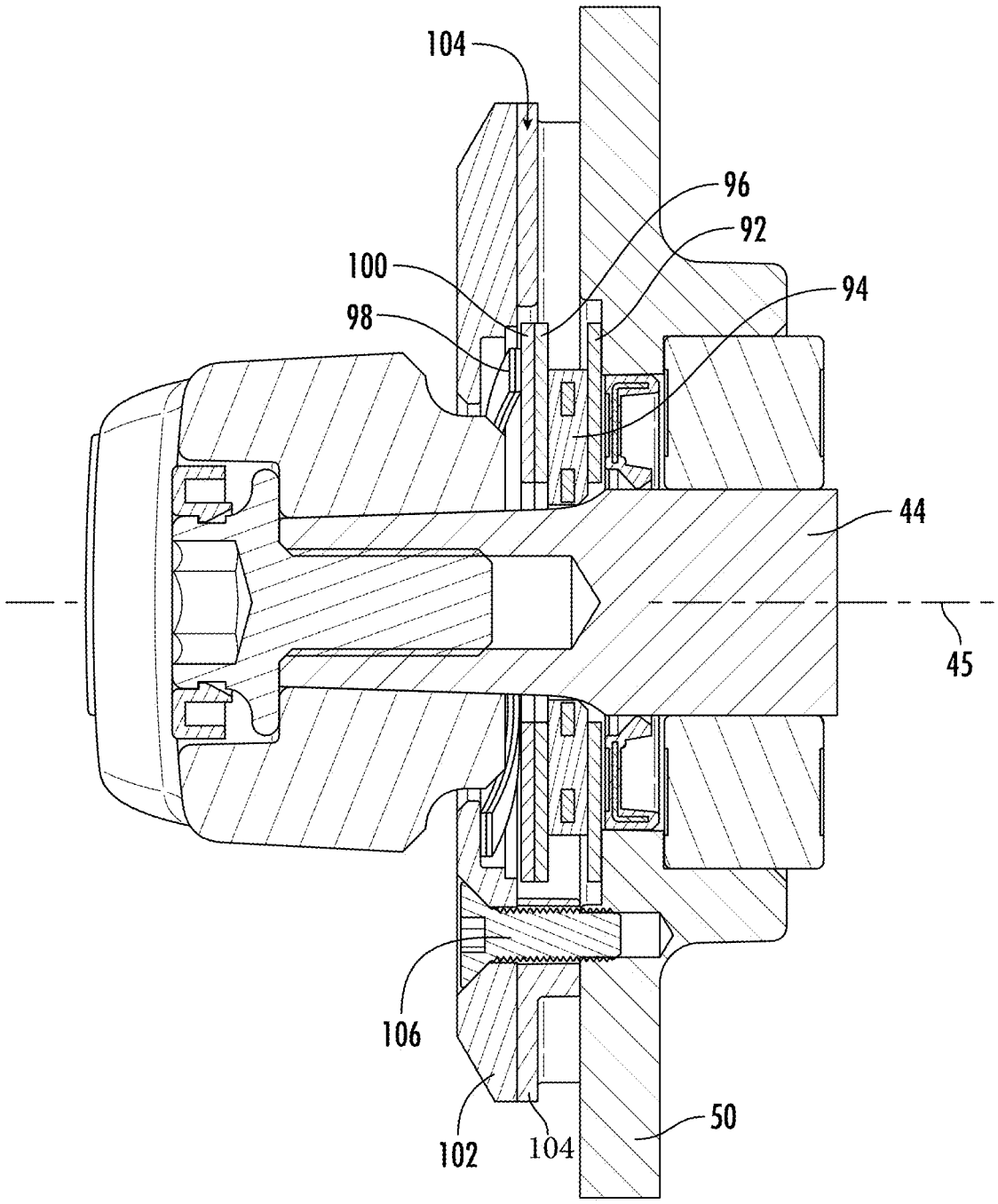
FIG. 5 is a cross-sectional illustration of a braking arrangement of the pedal drive system of FIG. 2.
Figure 6:
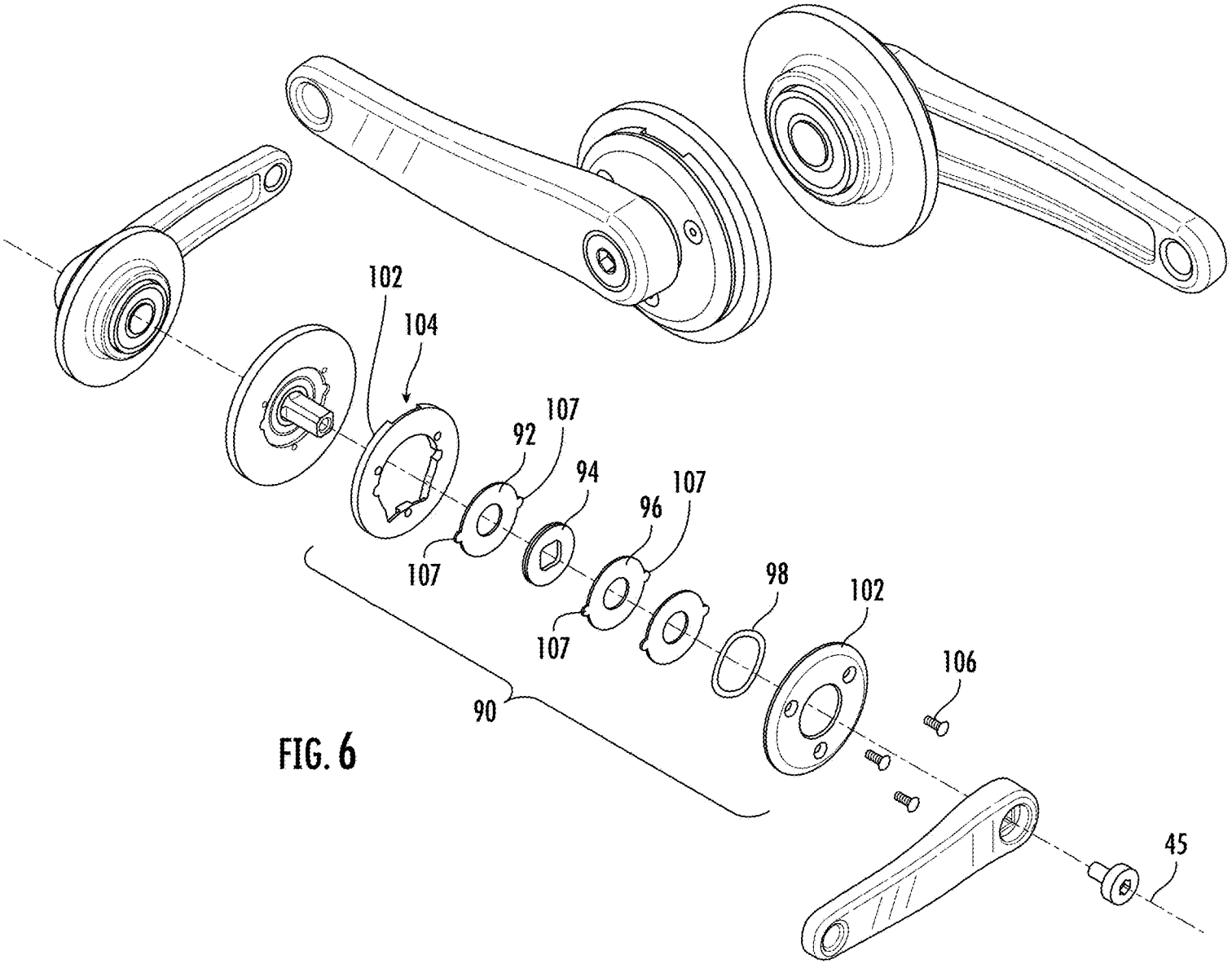
FIG. 6 is an exploded illustration of the braking arrangement of FIG. 5.

FIGS. 3-4 are simplified illustrations of the pedal drive system 22 with the outer housing removed to show portions of the assist drive train 52 and the manual drive train 55 and how they interact with the thrust unit 70 (represented generically by a drive shaft that extends down to the propeller.

The assist drive train 52 includes a plurality of gears interposed between electric motor 66 and bull and bevel gear 72. The gears between motor 66 and bull and bevel gear 72 are generally used to step down the output speed of motor 66. In other embodiments, the assist drive train 52 could include more or less gears between the motor 66 and bull and bevel gear 72. In some embodiments, the bull and bevel gear 72 may be directly driven by motor 66.

With reference to FIG. 4, the bull and bevel gear 72 is rotatably mounted for rotation about crankshaft axis 45. In this embodiment, a one-way clutch 73 provided between the bull and bevel gear 72 and the crankshaft 44. The bull and bevel gear 72, in this embodiment, is thus rotatably mounted to the crankshaft 44. The one-way clutch 73 allows torque to be operably transferred from the motor 66 to drive the thrust unit 70. However, it also allows for the crankshaft 44 to be overrun by the bull and bevel gear 72 about which the bull and bevel gear 72 is mounted.

For example, when a user wants to rely on the electric motor 66 to provide full power to drive thrust unit 70 but wants to rest his or her feet on the pedals in a stationary position, the one-way clutch allows the electric motor 66 to drive bull and bevel gear 72 without driving the user's feet and/or legs that are resting on the pedals.

In FIGS. 3-4, the thrust unit 70 is represented, at least in part, by a bevel gear 74 that is connected to a drive shaft 75. The bevel gear 74 is driven by bull and bevel gear 72.

In other embodiments, the bull and bevel 72 is provided by a single component rather than a plurality of components fixed to one another.

The pedal drive system 22 includes a coupling arrangement 80 that includes a coupler 82 that transitions the pedal drive system 22 between the assist mode and the manual mode. Examples of and the operation of potential coupling arrangements 80 are described in more detail in U.S. Patent Publ. 2021/0284309 and U.S. Pat. No. 11,148,775.

While the prior system works great to provide the user the ability to operate in manual or assist mode, it has been determined that due to resistance within the one-way clutch 73 and/or momentum within the system of the pedals 40, 42, cranks 40*a*, 42*a* and crankshaft 44 during pedaling in the manual mode that when transitioning from the manual mode to the assist mode, without the user's feet remaining on the pedals 40, 42, the manual drive train 55 (e.g. crankshaft 44, pedals 40, 42 and cranks 40*a*, 42*a*) can rotate about crankshaft axis 45. For example, if user wants to transition from pedaling and take his or her feet off the pedals 40, 42 while using the assist drive train 52 to supply power to the thrust unit 70, the pedals 40, 42 may continue to rotate about axis 45.

This can be a nuisance if the pedals run into the user or interfere with other activities by the user within the watercraft, e.g. fishing.

The pedal drive system 22 incorporates a pair of manual drive train brakes in the form of braking arrangements 90 to inhibit this rotation of the manual drive train 55. As these braking arrangements 90 are generally identical, only one will be described.

The braking arrangement 90 operates to ground the manual drive train 55 when not in use. In other words, it operates to inhibit movement relative to the watercraft when not in use.

In this example, the braking arrangement 90 resists movement of the manual drive train 55 relative to housing 50 of the pedal drive system 22, to which the crankshaft 44 is operably rotatably mounted.

In particular, a portion of the braking arrangement is fixedly attached to the housing 50 such that it does not move relative to the housing as a result of rotation of the crankshaft 44 and another cooperating portion that is fixedly attached to the crankshaft 44 that moves with the crankshaft 44 about axis 45 when it moves about axis 45.

In this example, the braking arrangement 90 includes a first friction pad 92 fixed relative to the drive system housing 50 such that rotation of the crankshaft 44 does not rotate the first friction pad 92 about axis 45. A second friction pad 94 is attached to the crankshaft 44 for rotation with the crankshaft 44 about the crankshaft axis 45. The second friction pad 94 operably engages the first friction pad 92 at least when the pedal drive system 22 is in the assist mode. The engagement between the first and second friction pads 92, 94 inhibits rotation of the crankshaft when the motor 66 powers the thrust unit 70.

In this example, the first friction pad 92 is grounded relative to housing 50 and the second friction pad 94 is permitted to move relative to the first friction pad 92 and housing 50. The friction therebetween inhibits motion of the crankshaft 44.

In this example, a third friction pad 96 is provided on an opposite side of the second fiction pad 94. The third friction pad 96 is similar to the first friction pad 92 and is operably fixed relative to the housing 50 such that rotation of crankshaft 44 does not rotate the third friction pad 96.

The crankshaft 44 extends through apertures in the friction pads 92, 94, 96. However, the crankshaft 44 mates with the second friction pad 94 such that rotation of the crankshaft 44 rotates the second friction pad 94 therewith. The apertures through the first and third friction pads 92, 96 are configured (e.g. sized or shaped) such that they do not or do not sufficiently engage the crankshaft 44 such that rotation of the crankshaft 44 rotates the first and third friction pads 92, 96 therewith.

A biasing member 98 provides a biasing force, typically parallel to axis 45, to bias the first and second friction pads 92, 94 into engagement. In this example, the biasing member 98 also biases the third friction pad 96 into the second friction pad 94.

The biasing member 98 in this example is a wave spring. In other examples, the biasing member could be in the form of a conical spring, an o-ring, a threaded ring that is threaded into the drive system housing 50 and that as it is threaded about axis 45 towards or away from the friction pads 92, 94, 96 the force applied thereto can be adjusted.

An anti-squeaking shim 100 is positioned axially between the biasing member 98 and the third friction pad 96. The anti-squeaking shim 100 prevents squeaking between the biasing member 98 if it were directly abutting one of the friction pads 92, 94, 96. Here, the biasing member 98 acts directly axially against anti-squeak shim 100.

The anti-squeaking shim 100 is optional. It may be formed from a material such as Delron.

A brake cover 102 covers the friction pads 92, 94, 96, biasing member 98 and the anti-squeak shim 100. The biasing member is biased against brake cover 102 on the end opposite the end that engages the anti-squeak shim 100.

The brake cover 102 includes a plurality of dust vents 104 that are vertically oriented that permit dust formed from sliding action between the friction pads 92, 94, 96 to exit the braking arrangement 90.

In this example, the brake cover 102 is formed from a pair of components that are fixed to the drive system housing 50 by screws 106.

Figure 7:
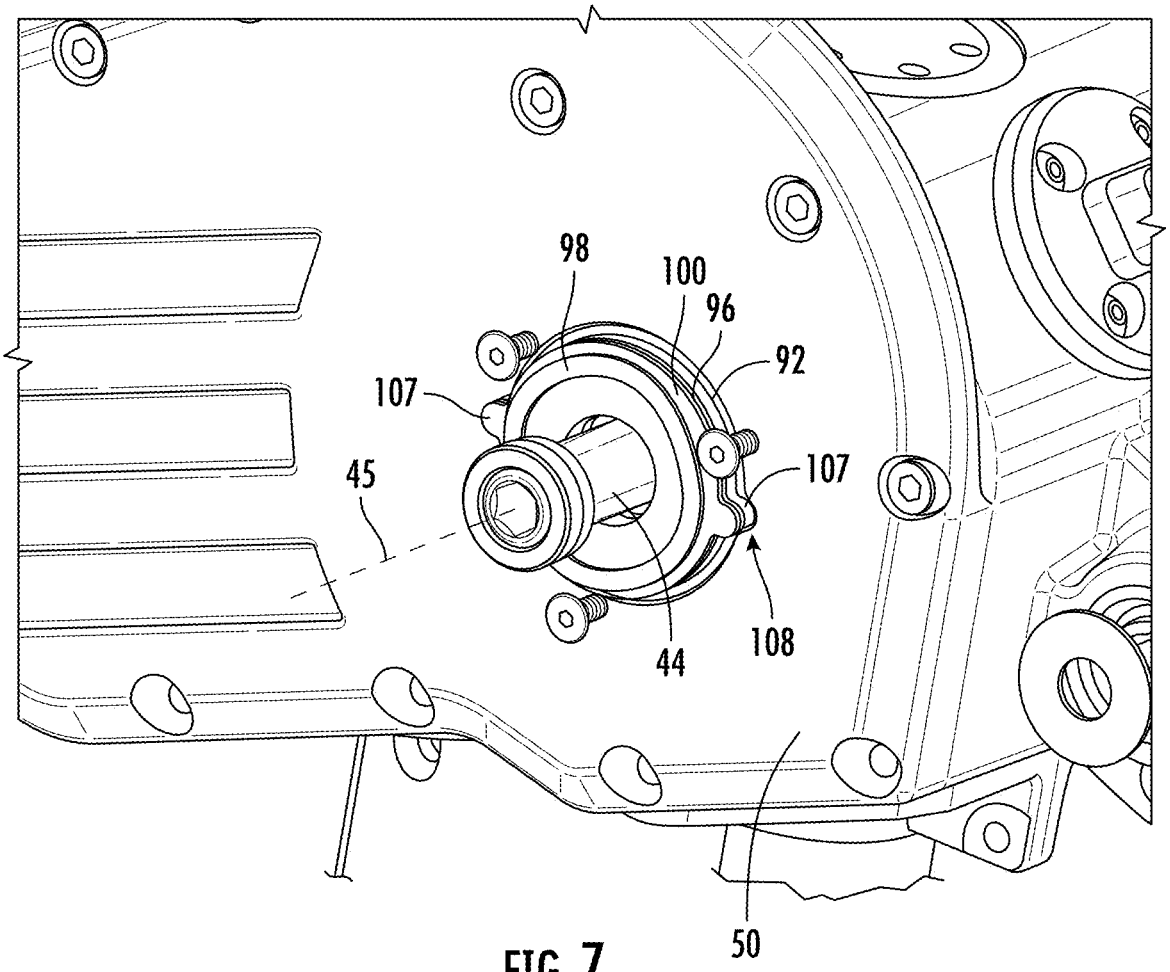
FIG. 7 is a partial illustration of the pedal drive system of FIG. 2 with components removed to illustrate friction pads of the braking system as they relate to the housing of the pedal drive system.

To prevent rotation of the first and third friction pads 92, 96, these pads include tabs 107 that extend into corresponding notches 108 formed in the housing 50. FIG. 7 has cover 102 removed and illustrates notches 108 in housing 50. The notches 108 allow at least the third friction pad 96 to move axially parallel to the crankshaft axis 45 but prevent angular rotation about crankshaft axis 45. This allows for the system to compensate for wear in the first, second, or third friction pads 92, 94, 96. Similarly, in this example, the second friction pad 94 is permitted to slide axially along the crankshaft axis 45 relative to crankshaft 44.

In some embodiments, only two friction pads are provided and only one need to be permitted to slide axially along the crankshaft axis 45.

While a single biasing member 98 is included in this example, a second biasing member could be provided that acts against the first friction pad 92 to bias it in the opposite direction as biasing member 98 is biasing the second and third friction pads 94, 96 in this example.

By using the wave spring as the biasing member 98, the biasing force provided by the biasing member 98 will remain substantially constant over the wear life of the braking arrangement.

In this example, the braking arrangement 90 is active at all times. Thus, in addition to being active during assist mode, it is also active during manual mode. As such, it will provide some additional resistance to pedaling. However, the resistance should be configured to minimize the amount of resistance when pedaling in manual or assist modes. While this provides additional resistance during pedaling, it does provide the benefit of limiting free-wheeling in the manual mode if the user removes their feet from the pedals.

In an alternative example, the braking arrangement could be deactivated when in the manual mode. For instance, an actuator could be provided that removes the axial force provided by biasing member 98 when in the manual mode.

The actuator could be manually activated in the assist mode. This could be done by pushing a lever or activating an electric actuator using a switch. In some examples, the activation of the braking arrangement 90 could occur automatically when the user activates the assist mode. For example, activating of assist mode could cause an actuator to activate the braking arrangement 90. Similarly, deactivating assist mode could actuate the actuator such that the braking arrangement 90 is deactivated.

In the illustrated example, the friction provided between the friction pads 92, 94, 96 is sufficient to stop rotation of the crankshaft 44 as a result of momentum from pedaling and/or due to any torque transferred to the crankshaft 44 when operating in the assist mode through one-way clutch 73. As such, this allows the bull and bevel gear 72 to overrun the crankshaft 44 in the assist mode such that the pedals 40, 42 do not rotate when the assist mode is activated.

Figure 8:
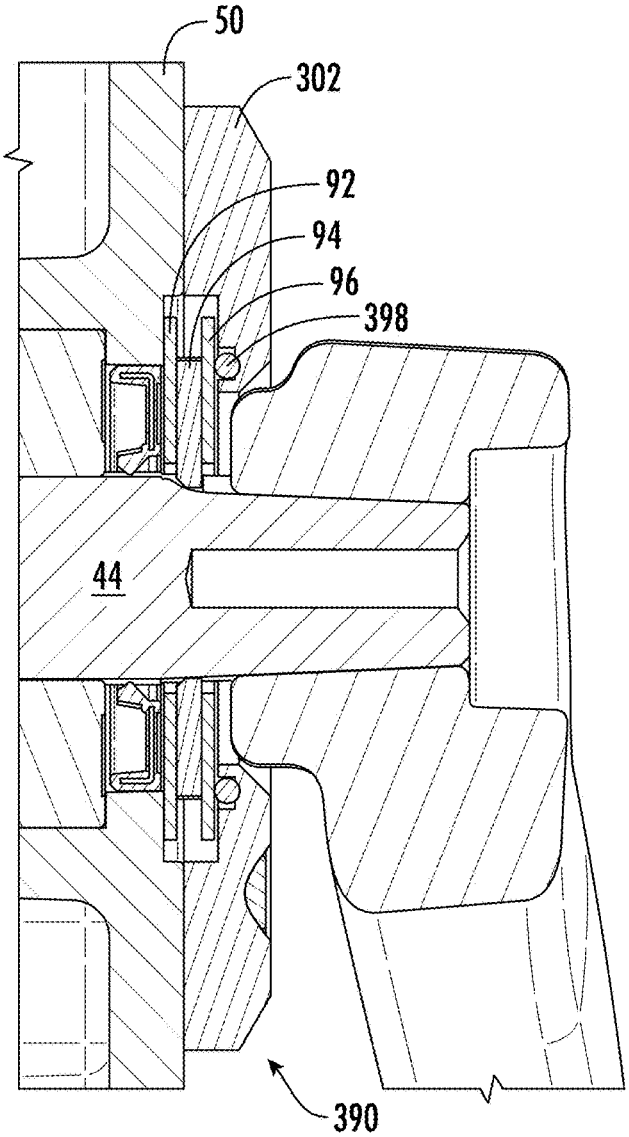
FIG. 8 is a cross-sectional illustration of a further braking arrangement.
Figure 9:
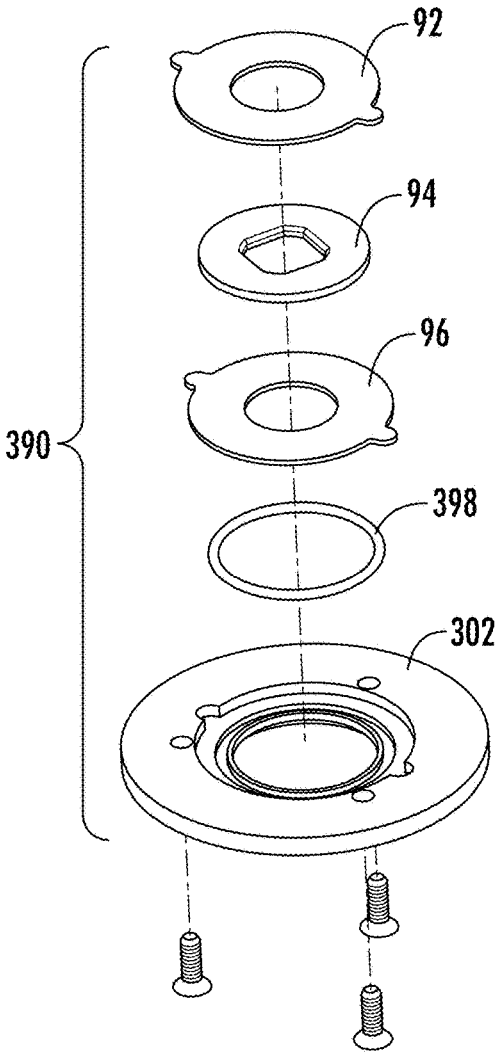
FIG. 9 is an exploded illustration of components of the braking arrangement of FIG. 8.

FIGS. 8 and 9 illustrate a further example of a manual drive train brake 390. This embodiment uses o-ring 398 as the biasing member to provide the axial forces to press the friction pads 92, 94, 96 axially into engagement as outlined above. Compression of the o-ring provides the axial force.

Figure 10:
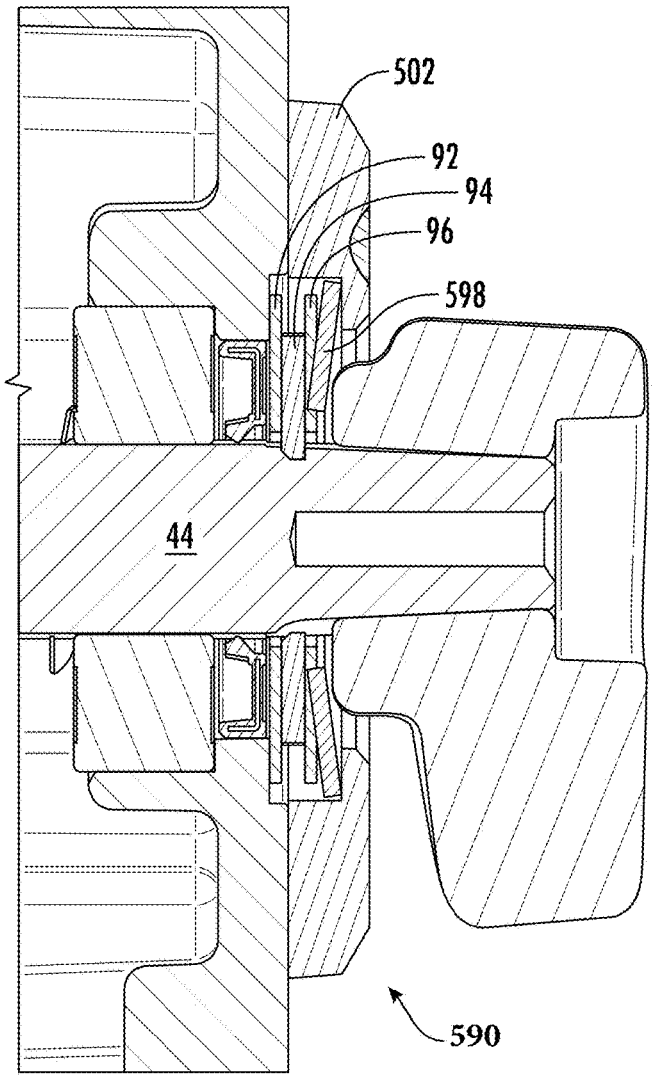
FIG. 10 is a cross-sectional illustration of a further braking arrangement.
Figure 11:
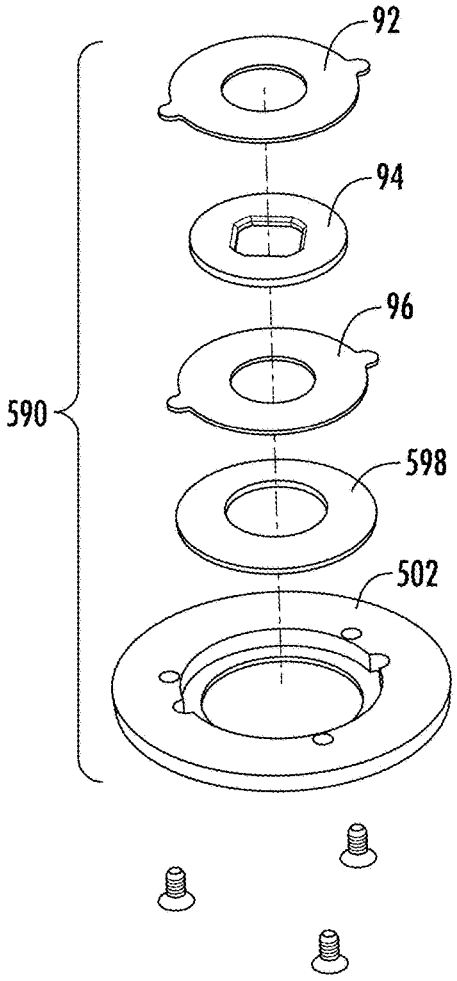
FIG. 11 is an exploded illustration of components of the braking arrangement of FIG. 10.

FIGS. 10 and 11 illustrate a further example of a manual drive train brake 590. This embodiment uses conical spring 598 as the biasing member to provide the axial forces to press the friction pads 92, 94, 96 axially into engagement as outlined above. Compression of the conical spring 598 provides the axial force.

Figure 12:
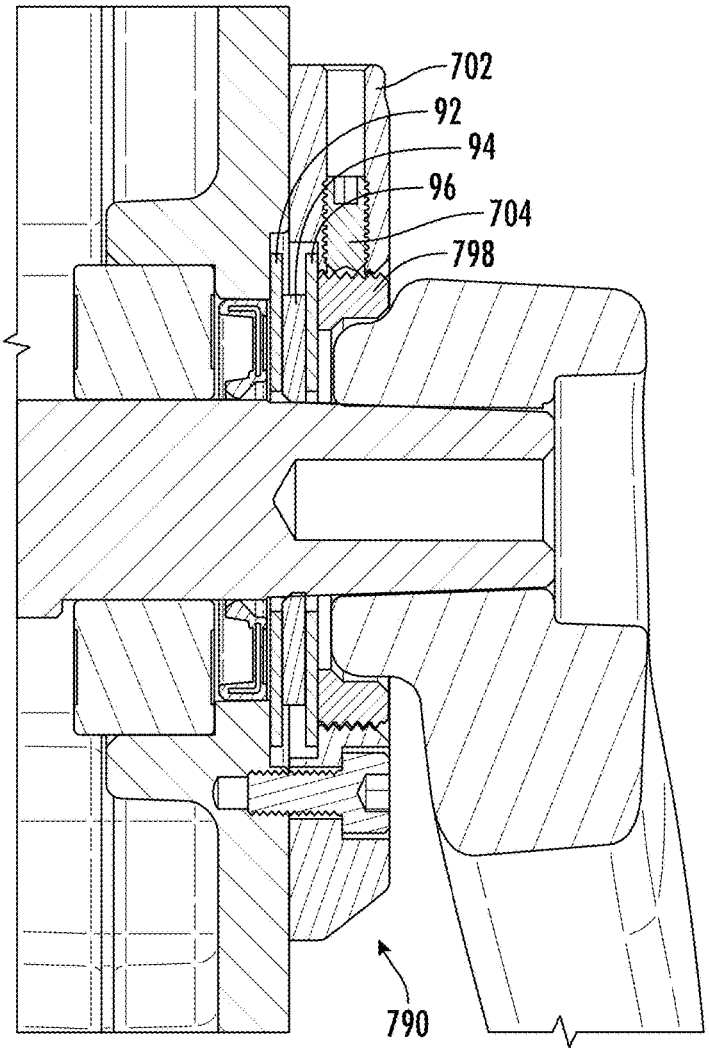
FIG. 12 is a cross-sectional illustration of a further braking arrangement.
Figure 13:
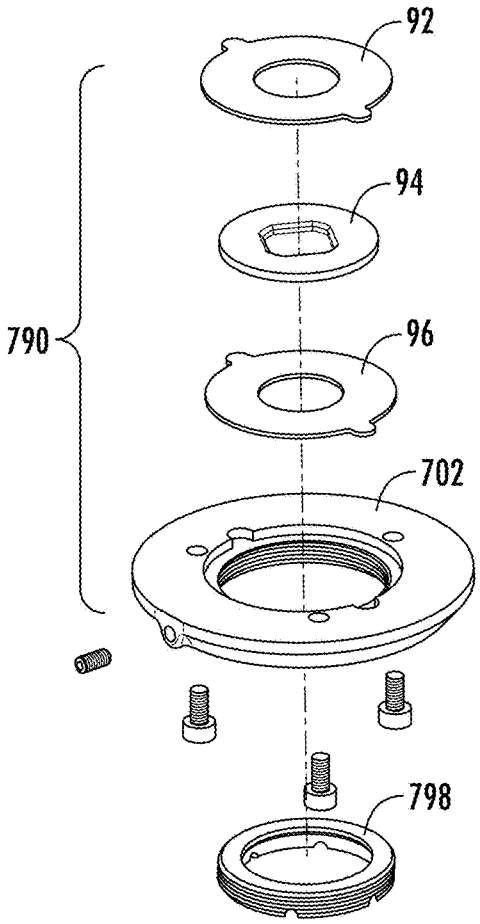
FIG. 13 is an exploded illustration of components of the braking arrangement of FIG. 12.

FIGS. 12 and 13 illustrate a further example of a manual drive train brake 790. This embodiment uses a threaded member 798 as the biasing member to provide the axial forces to press the friction pads 92, 94, 96 axially into engagement as outlined above. To adjust the amount of axial force, such as due to wear, the threaded member 798 can be threaded relative to cover member 702 parallel to axis 45 of the crankshaft 44. A locking member 704 threaded into the cover member 702 radially engages the threaded member 798 to prevent rotation of threaded member 798 to maintain the axial biasing force.

Figure 14:
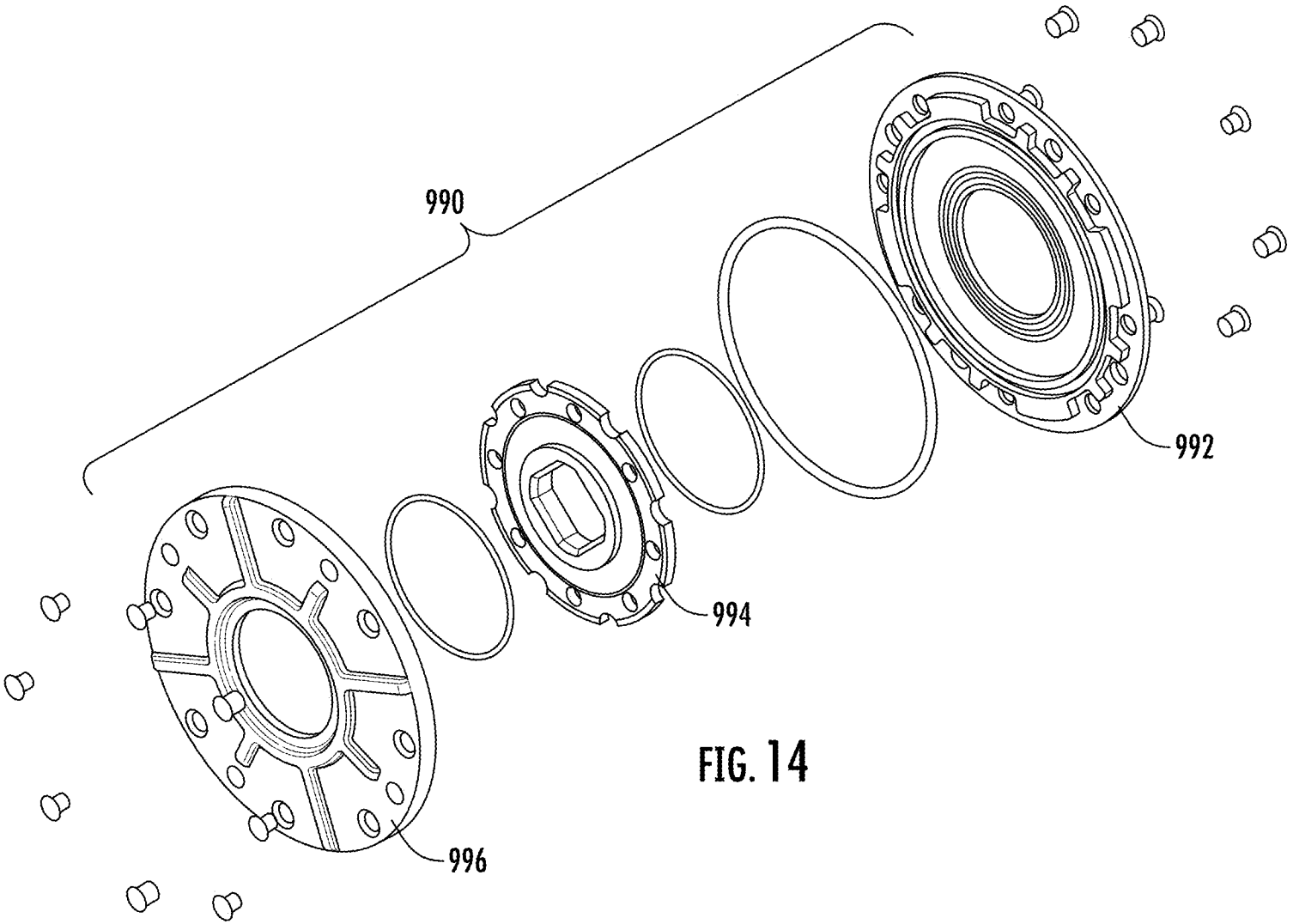
FIG. 14 is an exploded illustration of a further braking arrangement.
Figure 15:
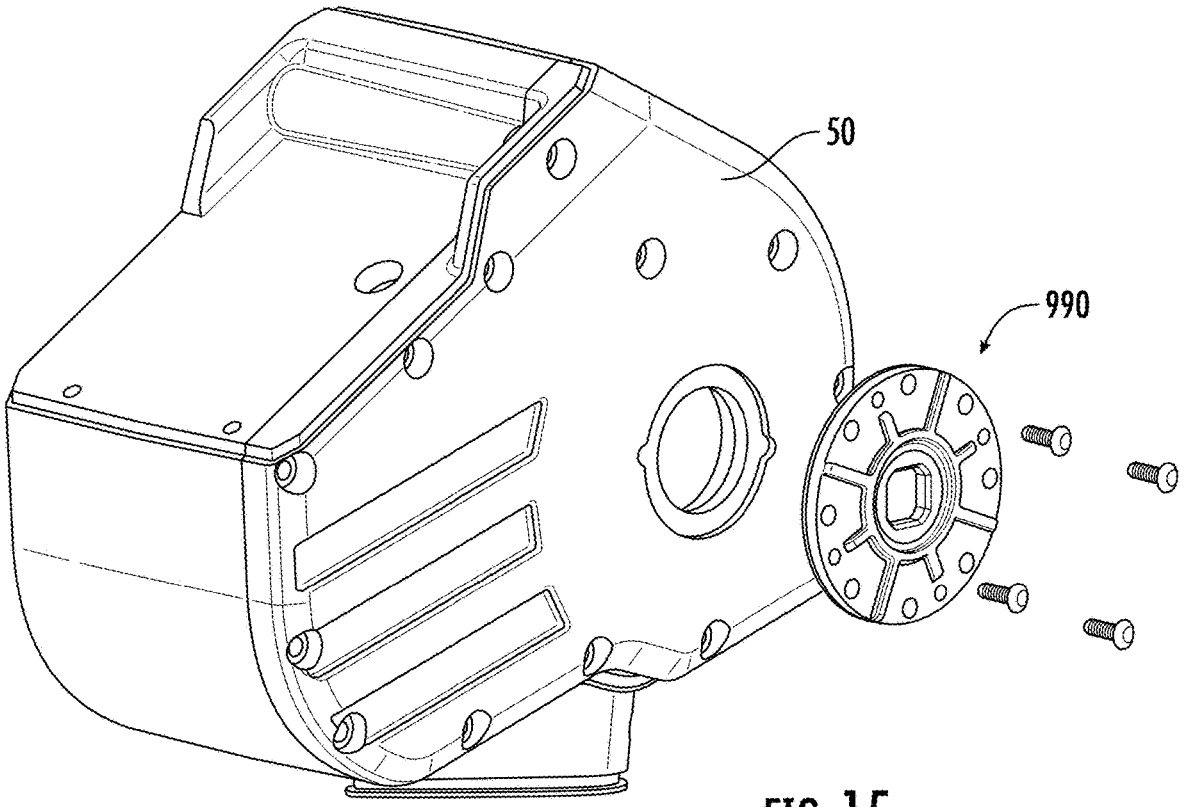
FIG. 15 illustrates the braking arrangement of FIG. 4 removed from the housing of the pedal drive system.
Figure 16:
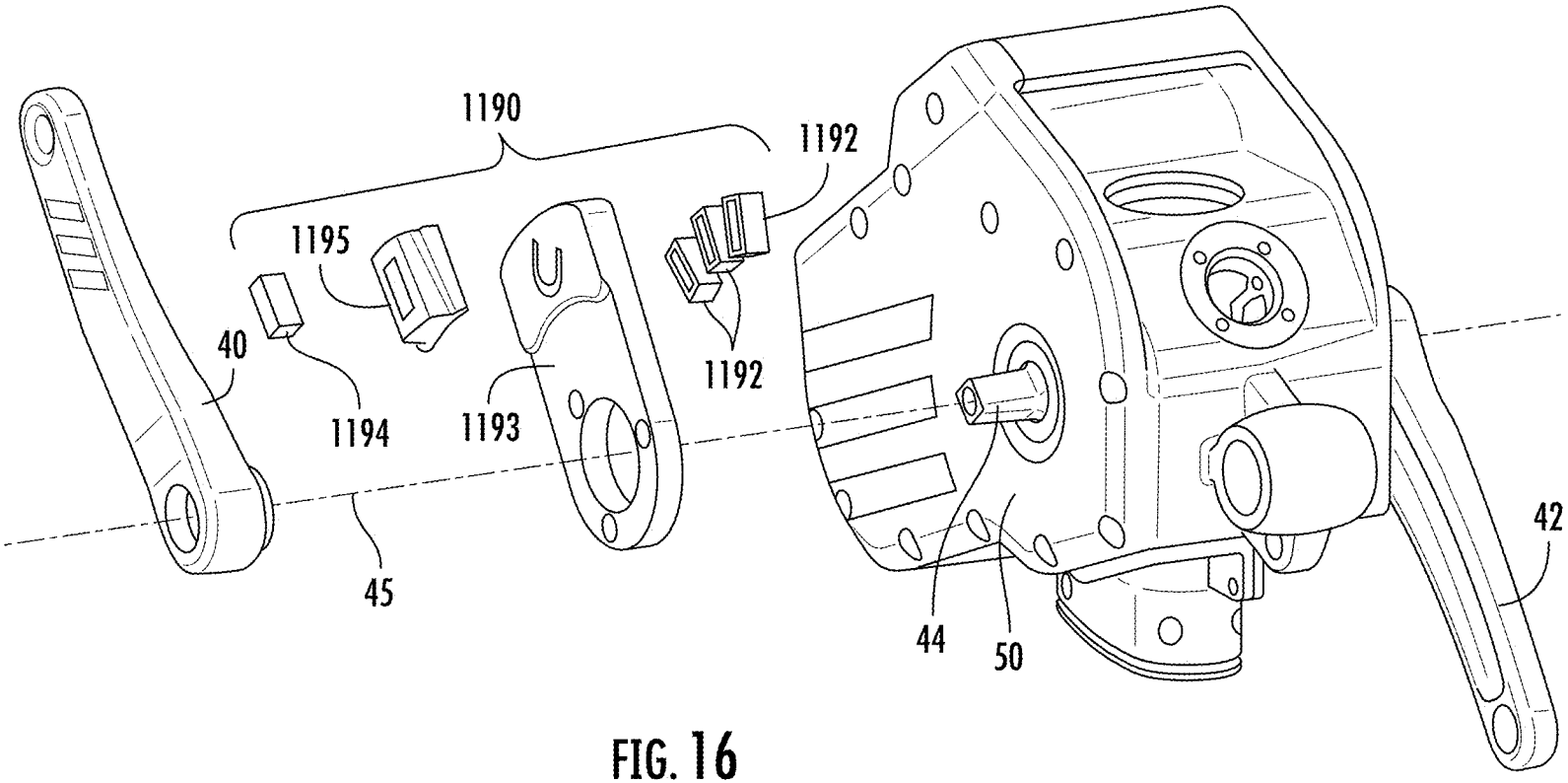
FIG. 16 is an exploded illustration of a further braking arrangement.
Figure 17:
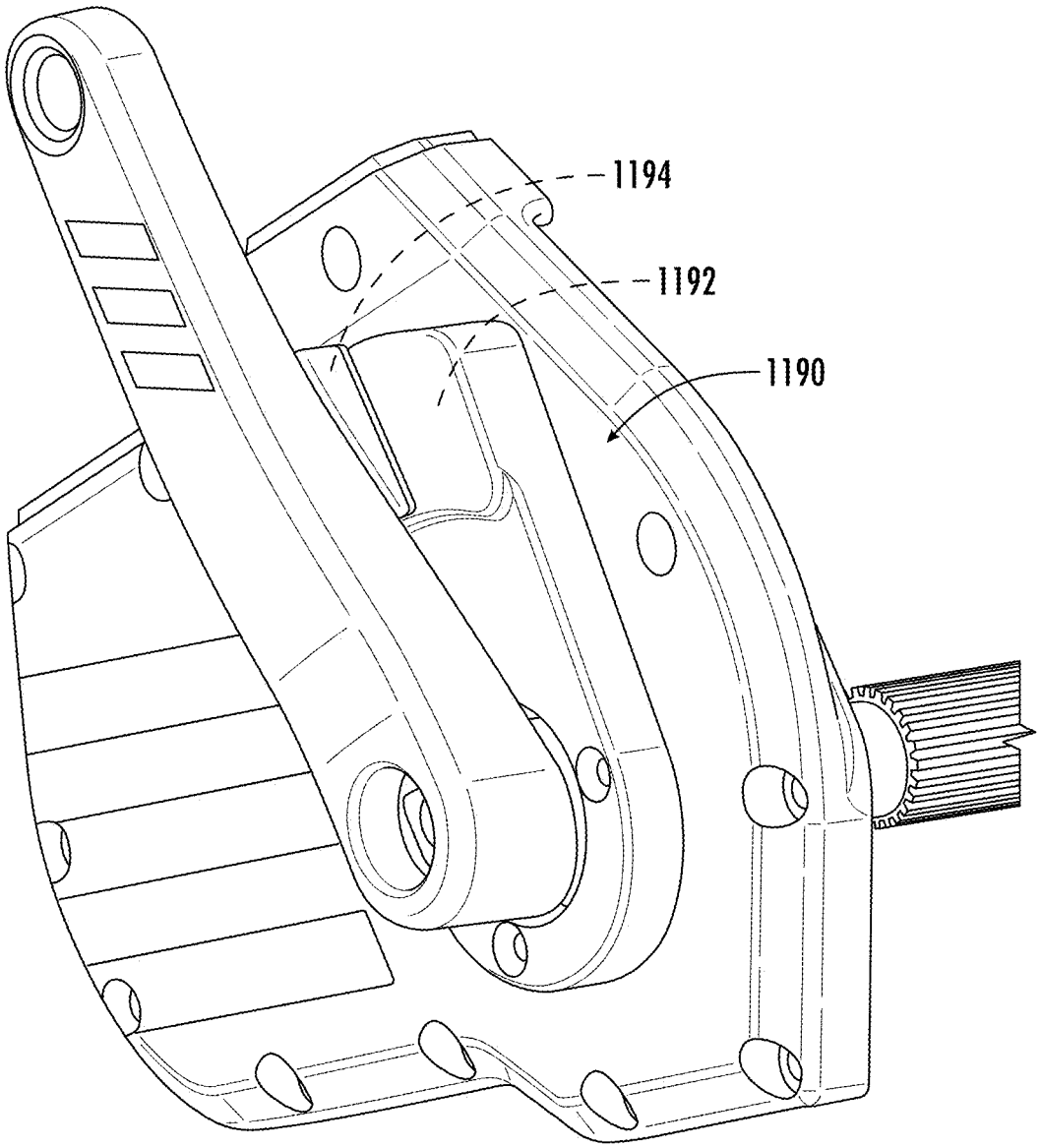
FIGS. 17 and 19 are perspective illustrations of the braking arrangement of FIG. 16 mounted to the pedal drive system housing.
Figure 19:
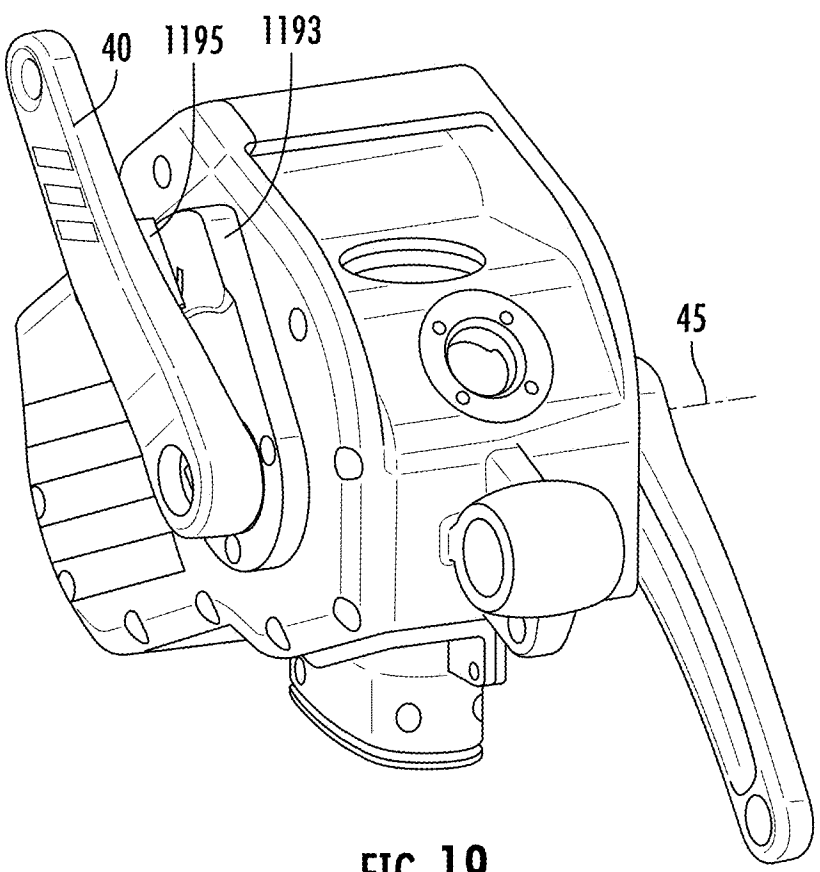
Figure 18:
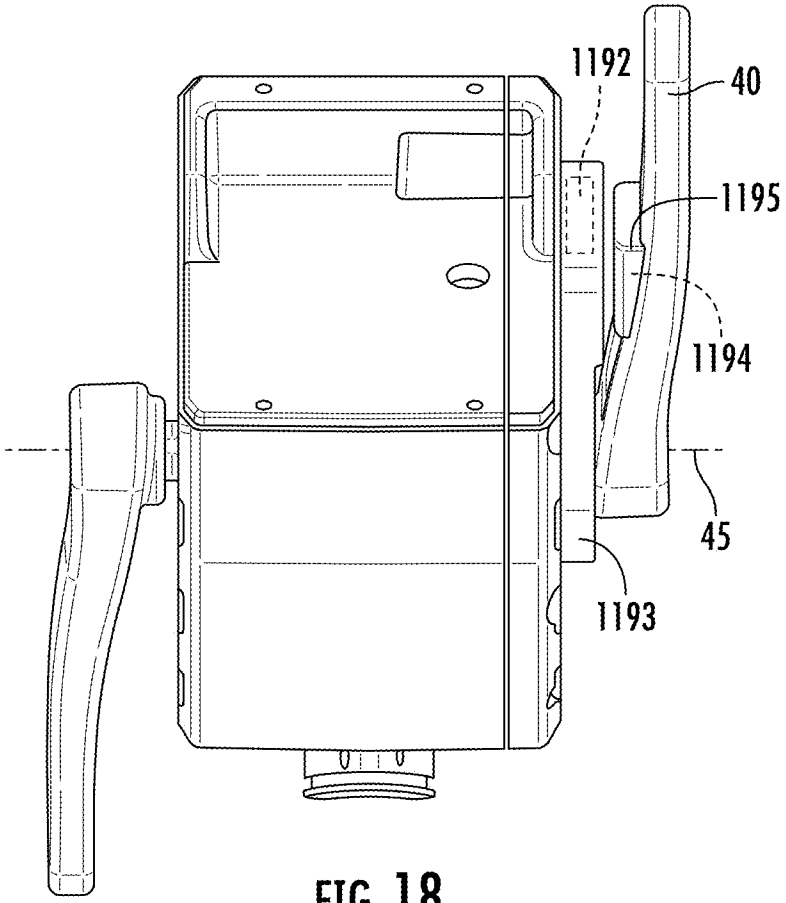
FIG. 18 is a plan view illustration of the braking arrangement of FIG. 16 mounted to the pedal drive system housing.

FIGS. 14 and 15 illustrated a further example of a manual drive train brake 990. This example uses a fluid damping system for resisting rotation of the crankshaft 44. Here, a rotor 994 is rotationally fixed to the crank shaft 44. The rotor 994 is located within a sealed housing formed by housing members 992, 996. A viscous fluid is located within a chamber formed by housing members 992, 996. The viscous fluid acts on the rotor 994, which provides resistance against rotation of rotor 994 and consequently crankshaft 44.

The amount of resistance can be modified by changing the viscosity of the viscous fluid and/or the configuration of rotor 994.

A plurality of o-ring seals may be provided to seal the rotor 994 within housing members 992, 996. The housing members 992, 996 are rotationally fixed relative to housing 50 to prevent rotation thereof when the crankshaft 44 rotates about axis 45.

FIGS. 16-19 illustrate a further example of a braking arrangement 1190. In this example, a plurality of first magnet members 1192 are operably attached to housing 50. The first magnet members 1192 are fixed relative to the housing 50 when crankshaft 44 is rotated. While a plurality of first magnet members 1192 are illustrated, it is contemplated that a single first magnet member could be provided.

In this example, the first magnet members 1192 are mounted to a magnet carrier 1193, which is attached to an outer surface of housing 50.

A second magnet member 1194 is attached to the crank 40 such that the second magnet member 1194 operably rotates about axis 45 with crank 40. The second magnet member 1194 cooperates with the first magnet members 1192 in at least the assist mode to inhibit rotation of the crankshaft 44. The second magnet member 1194 is carried in a magnet carrier 1195 which is attached to the crank 40.

In one example, the first magnet members 1192 and the second magnet members have opposite poles directed toward one another such that when the second magnet member 1194 is angularly aligned with one or all of the first magnet members 1192, the magnets are attracted to one another.

It is contemplated that the same pole could be used for the first magnet members 1192 and the second magnet member 1194 if it were possible to trap the second magnet member 1192 between adjacent first magnet members 1192.

In one example, one or more of the magnet members is an electromagnet. The electromagnet may always be powered or may be powered only during the assist mode. This would allow for reduced resistance during manual pedaling. In one example, the electromagnet is automatically activated when the assist mode is activated.

In other examples, similar to outlined above, an actuator could be used to move one or more of the magnets axially away from the other type of magnet so that the magnetic force is significantly reduced during manual mode and to thereby reduce resistance in the manual mode.

Figure 20:
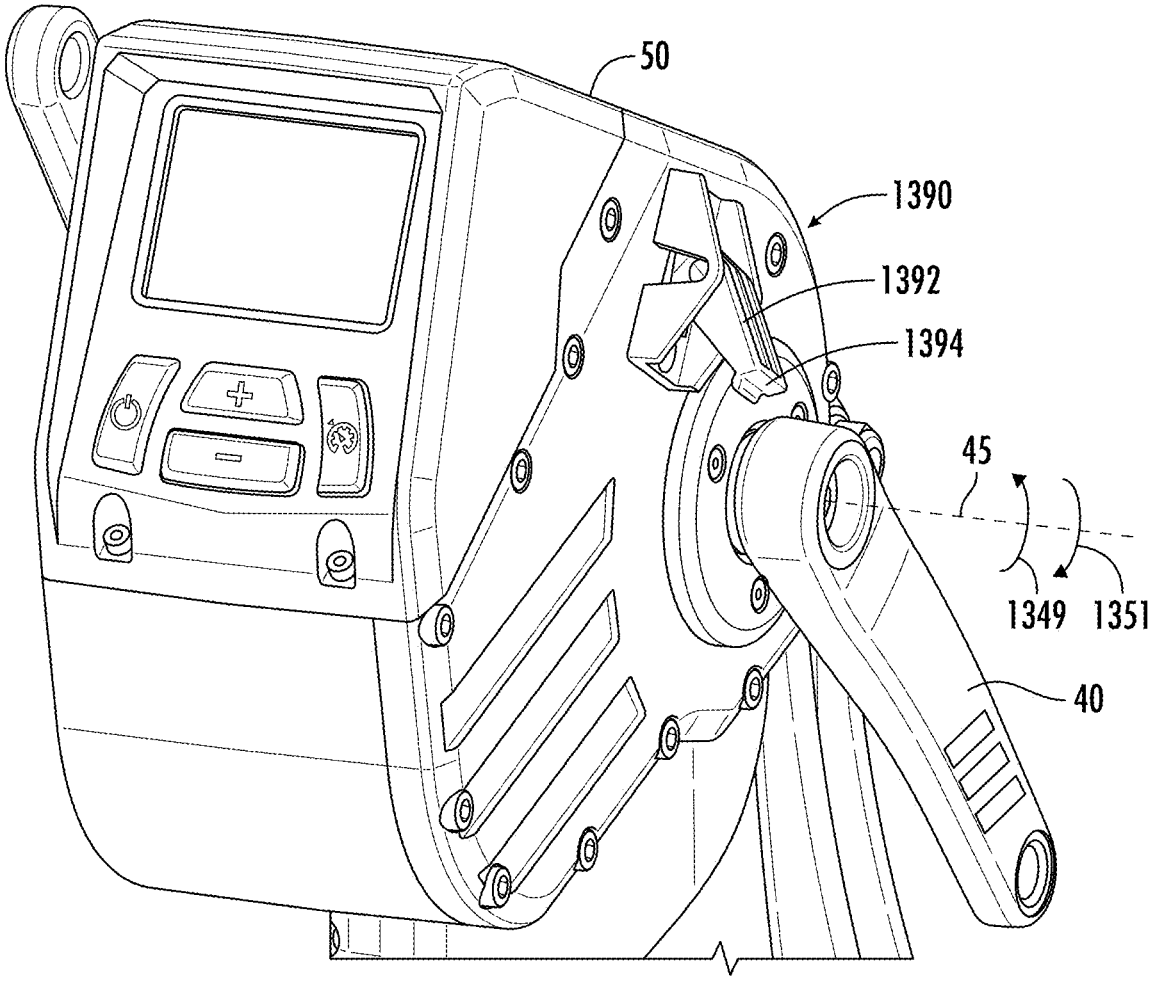
FIG. 20 is a perspective view of a further braking arrangement mounted to a housing of a pedal drive system in a blocking orientation.
Figure 21:
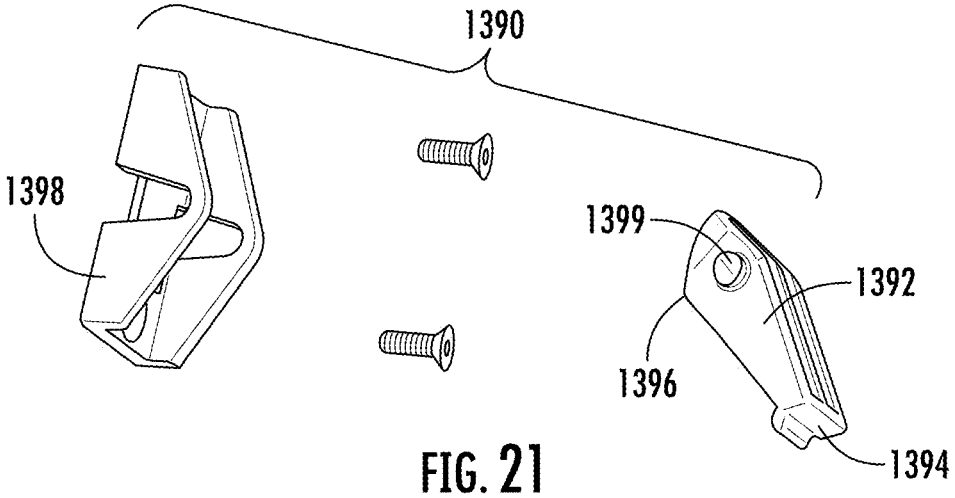
FIG. 21 is an exploded illustration of the braking arrangement of FIG. 20.

FIGS. 20 and 21 illustrate a further example of a braking arrangement 1390. In this example, a retractable manual lever 1392 extends outward from the side of housing 50. The manual lever 1392 extends sufficiently far that it extends in to the path of crank 40 as crank 40 rotates about axis 45. Thus, when the crank 40 rotates in a first direction it engages abutment end 1394 of the manual lever 1392 to stop rotation of crank 40 and consequently manual drive train 55.

The manual lever 1392 is movable between a blocking position and a retracted position. The blocking position is illustrated in FIG. 20. Again, the abutment end 1394 engages crank 40 when the crank rotates in direction 1351 about axis 45. In the retracted position, the manual lever 1392 does not engage the crank 40 when the crankshaft 44 is rotated about the crankshaft axis 45.

Manual lever 1392 may be configured such that when in the blocking position, the manual lever 1392 is configured to transition towards the retracted position when engaged by the crank 40 when the crankshaft 44 is rotated in a second direction 1349, opposite the first direction 1351.

The first direction 1351 may be the direction of pedaling that provides a forward thrust with thrust unit 70, which may be referred to as pedaling forward. Second direction 1349 may be the direction of pedaling that provides a rearward thrust with thrust unit 70, which may be referred to as pedaling in reverse.

As such, if a user attempts to pedal in reverse with the manual lever 1392 extended into the blocking position, the manual lever 1392 would not stop pedaling. Instead, the crank 40 would push the manual lever 1392 towards housing 50 until it gets angularly past the manual lever 1392.

In one example, when the user performs the reverse pedal operation, the manual lever 1392 will remain in the retracted position after the crank 40 has cleared the manual lever 1392.

Figure 22:
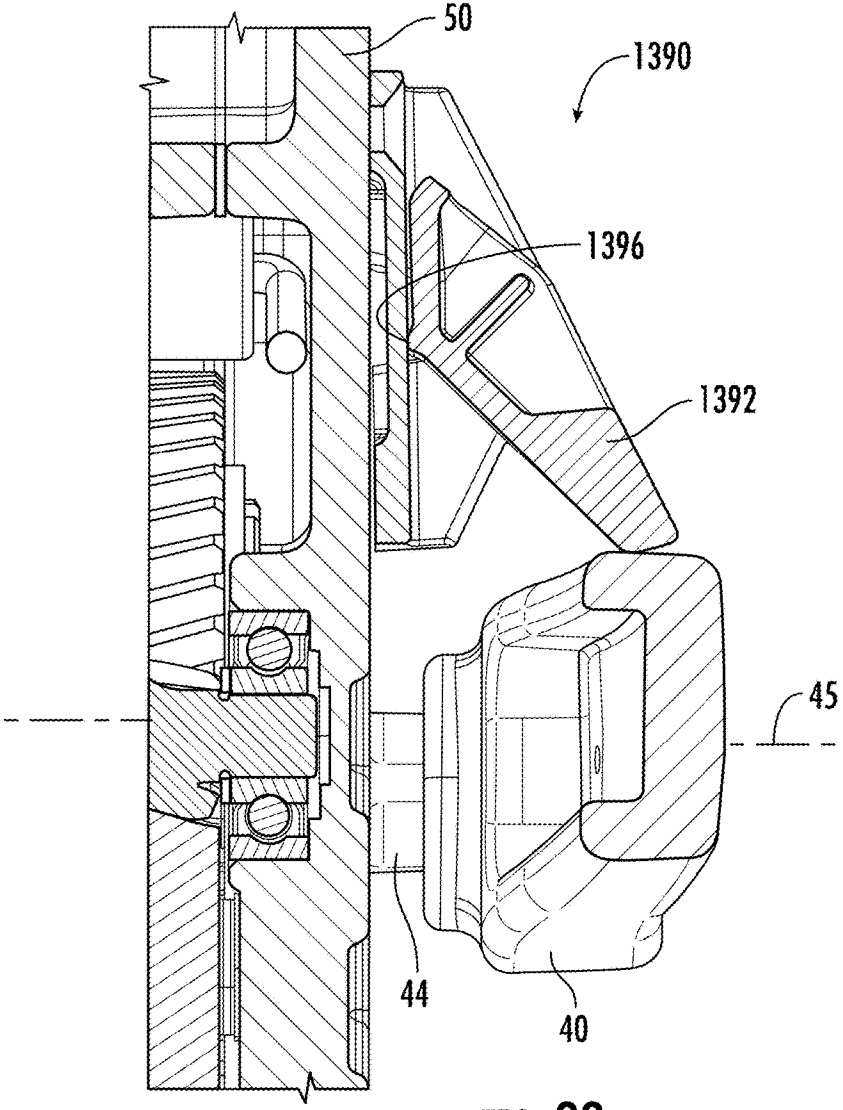
FIG. 22 is a cross-sectional illustration of the braking arrangement of FIG. 20 in a blocking position.

In some examples, the manual lever 1392 could be biased towards the blocking position when in the blocking position such that the manual lever 1392 would return to the blocking position once the crank 40 angularly clears the manual lever 1392. In the illustrated example, manual lever 1392 includes over-center projection 1396 that provides this biasing force (see FIG. 22).

Figure 23:
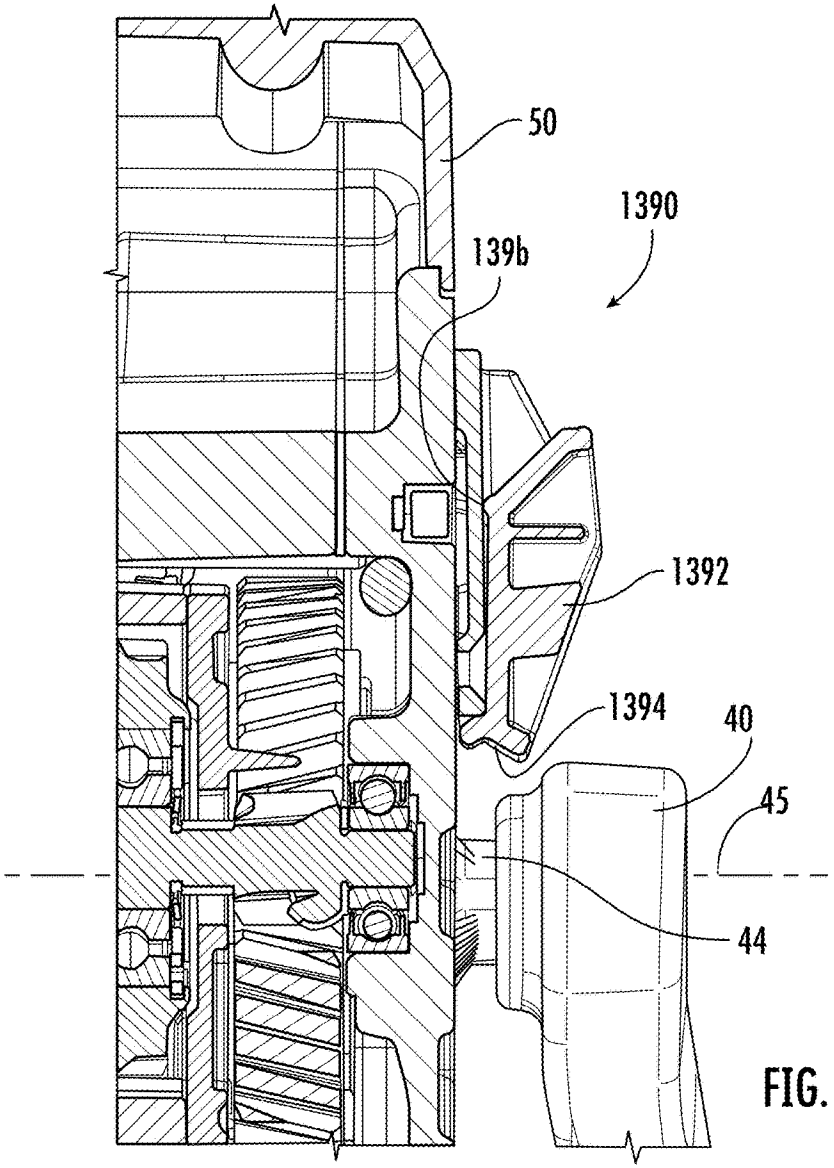
FIG. 23 is a cross-sectional illustration of the braking arrangement of FIG. 20 in a retracted position.

Further, in some examples, the manual lever 1392 could be biased towards the retracted position when in the retracted position such that if the manual lever 1392 is moved towards the blocking position but not sufficiently far, the manual lever 1392 will be biased back towards the housing 50. In the illustrated example, over-center projection 1396 that provides this biasing force (see FIG. 23). Not sufficiently far would be when the manual lever 1392 has not moved over-center relative to over-center projection 1396.

The manual lever 1392 is mounted to the housing 50 by a mounting bracket 1398 that includes a pair of spaced apart upstanding walls. Each wall has a slit that receives outward extending pivot pins 1399 that are formed on opposed sides of the manual lever 1392. The manual lever 1392 pivots relative to the mounting bracket 1398 by way of pivot pins 1399.

Some of the braking arrangements described above may be considered always on. For example, the braking arrangement is always on if it provides resistance during both manual and assist modes. In those instances, the braking resistance is only sufficient to impede the free rotation of the manual drive train so as to limit the resistance during manual operation as well as to limit unnecessary resistance to the assist drive train to limit wearing down the power source.

Some arrangements can be configured to be activated and deactivated. This can be done manually by the user by flipping a switch or lever. In some instances, this can be done by automatically activating and deactivating upon activating and deactivating the assist drive train, respectively.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A pedal drive system for a watercraft, comprising:

a thrust unit having a propeller;

a manual drive train comprising a pair of pedals mechanically attached to a crankshaft for rotation of the crankshaft about a crankshaft axis, in at least a manual pedal mode, the manual drive train is connected to the thrust unit to input power to the thrust unit by pedaling of the pair of pedals;

an assist drive train having a motor, in at least an assist mode, the assist drive train is connected to the thrust unit to input power to the thrust unit;

a manual drive train brake acting on the manual drive train such that when the assist drive train is powering the thrust unit in the assist mode, motion of the crankshaft about the crankshaft axis is inhibited.

2. The pedal drive system of claim 1, wherein:

the crankshaft is rotatably mounted to a drive system housing;

the manual drive train brake includes:

a first friction pad fixed relative to the drive system housing such that rotation of the crankshaft does not rotate the first friction pad;

a second friction pad attached to the crankshaft for rotation with the crankshaft about the crankshaft axis, the second friction pad engaging the first friction pad at least when in the assist mode to inhibit rotation of the crankshaft when the motor powers the thrust unit.

3. The pedal drive system of claim 2, wherein:

the first friction pad is biased against the second friction pad by a biasing member.

4. The pedal drive system of claim 3, wherein the biasing member is at least one of a wave spring, a conical spring, an o-ring, or a threaded ring that is threaded into the drive system housing.

5. The pedal drive system of claim 2 wherein:

the manual drive train brake includes a third friction pad fixed relative to the drive system housing such that rotation of the crankshaft does not rotate the third friction pad; and the second friction pad being sandwiched axially between the first and third friction pads.

6. The pedal drive system of claim 2, wherein at least one of the first and second friction pads are axially slidable along the crankshaft axis.

7. The pedal drive system of claim 3, wherein:

the manual drive train brake includes a third friction pad fixed relative to the drive system housing such that rotation of the crankshaft does not rotate the third friction pad; and;

the second friction pad being sandwiched axially between the first and third friction pads;

the biasing member biases the third friction pad and the second friction pad towards the first friction pad;

the second friction pad is axially slidable along the crankshaft axis towards the first friction pad upon wear of the second, the first, or the second and first friction pads.

8. The pedal drive system of claim 3, wherein:

the manual drive train brake includes a third friction pad fixed relative to the drive system housing such that rotation of the crankshaft does not rotate the third friction pad; and;

the second friction pad being sandwiched axially between the first and third friction pads;

the biasing member biases the third friction pad and the second friction pad towards the first friction pad;

the third friction pad is axially slidable along the crankshaft axis towards the first friction pad upon wear of the first, the second, the third friction pads, or any combination thereof.

9. The pedal drive system of claim 1, wherein the crankshaft is rotatably mounted to a drive system housing;

the manual drive train brake includes:

a first magnet member fixed relative to the drive system housing such that rotation of the crankshaft does not rotate the first magnet member;

a second magnet member operably attached to the crankshaft for rotation with the crankshaft about the crankshaft axis, the second magnet member interacting with the first magnet member at least when in the assist mode to inhibit rotation of the crankshaft when the motor powers the thrust unit.

10. The pedal drive system of claim 9, further comprising a third magnet member that is either:

A) fixed relative to the drive system housing and having the same magnetic characteristic as the first magnet member or B) operably attached to the crankshaft for rotation with the crankshaft about the crankshaft axis and having the same magnetic characteristic as the second magnet member.

11. The pedal drive system of claim 9, wherein at least one of the first and second magnet members is an electromagnet that can be activated and deactivated.

12. The pedal drive system of claim 11, wherein the electromagnet is activated when in the assist mode and is deactivated when in the manual mode.

13. The pedal drive system of claim 12, wherein the electromagnet is automatically activated when assist mode is activated.

14. The pedal drive system of claim 1, wherein:

the crankshaft is rotatably mounted to a drive system housing;

the manual drive train brake includes:

a fluid housing fixed relative to the drive system housing such that rotation of the crankshaft relative to the drive system housing does not rotate the fluid housing;

a fluid located within the fluid housing;

a rotor element engaging the fluid within the fluid housing, the rotor element operably attached to the crankshaft to rotate with the crankshaft when in the assist mode to inhibit rotation of the crankshaft when the motor powers the thrust unit.

15. The pedal drive system of claim 1, wherein the crankshaft is rotatably mounted to a drive system housing;

the manual drive train brake includes:

a manual lever mounted to drive system housing, the manual lever is movable between a blocking position and a retracted position, wherein:

in the blocking position the manual lever is configured to engage a crank arm radially extending from the crankshaft and prevent rotation of the crankshaft in a first direction about the crankshaft axis when in the assist mode due to the motor powering the thrust unit;

in the retracted position, the manual lever does not engage the crank arm when the crankshaft is rotated about the crankshaft axis.

16. The pedal drive system of claim 15, wherein:

when in the blocking position, the manual lever is configured to transition towards the retracted position when engaged by the crank arm when the crankshaft is rotated in a second direction, opposite the first direction; and when the crank arm rotates past the manual lever when the crankshaft is rotating in the second direction, the manual lever returns to the blocking position.

17. The pedal drive system of claim 15, wherein the manual lever has an over-center arrangement that:

opposes transitioning the manual lever into the retracted position from the blocking position when the manual lever has been transitioned into the blocking position; and opposes transitioning the manual lever into the blocking position from the retracted position when the manual lever has been transitioned into the retracted position.

18. The pedal drive system of claim 1, wherein manual drive train brake is not active when in the manual mode.

19. The pedal drive system of claim 2, wherein:

the manual drive train brake has an active configuration in which the first friction pad is biased against the second friction pad and a deactivated configuration in which the first friction pad is not biased against the second friction pad;

the manual drive train brake automatically transitions from the deactivated configuration to the active configuration when the assist mode is activated; and the manual drive train brake includes an actuator that transitions the manual drive train brake between the deactivated configuration and the active configuration.

20. The pedal drive system of claim 1, including:

a first gear driven by the motor of the assist drive train for rotation about the crankshaft axis when in the assist mode to transfer power from the motor to the thrust unit;

a one-way clutch interposed between the first gear and the crankshaft that permits the first gear to overrun the crankshaft when the first gear is driven by the motor in the assist mode;

wherein the crankshaft is operably connected to the first gear in the manual mode such that rotation of the crank drives the first gear when in the manual mode and transfers power from a pair of pedals operably connected to the crankshaft to the thrust unit via the first gear and the crankshaft.

* * * * *